US008695518B2

(12) United States Patent
Landoni

(10) Patent No.: US 8,695,518 B2
(45) Date of Patent: Apr. 15, 2014

(54) MACHINE AND METHOD FOR SEWING, EMBROIDERING, QUILTING AND/OR THE LIKE EMPLOYING CURVED SEWING NEEDLES WITH CORRESPONDING MOVEMENT OF NEEDLE BARS

(76) Inventor: Alberto Landoni, Fagnano Olona (IT)

( * ) Notice: Subject to any disclaimer, the term of this patent is extended or adjusted under 35 U.S.C. 154(b) by 1019 days.

(21) Appl. No.: 12/696,960

(22) Filed: Jan. 29, 2010

(65) Prior Publication Data

US 2010/0192822 A1 Aug. 5, 2010

Related U.S. Application Data

(60) Provisional application No. 61/148,716, filed on Jan. 30, 2009.

(51) Int. Cl.
*D05B 23/00* (2006.01)

(52) U.S. Cl.
USPC ..... 112/470.13

(58) Field of Classification Search
USPC ..... 112/163, 165, 176, 177, 162, 175.24, 112/198, 470.11, 470.13, 470.05, 470.06, 112/475.24, 475.17, 35, 37, 78
See application file for complete search history.

(56) References Cited

U.S. PATENT DOCUMENTS

| | | | | |
|---|---|---|---|---|
| 1,734,822 | A | 11/1929 | Mueller | |
| 1,823,059 | A | 9/1931 | Merrick | |
| 3,347,190 | A * | 10/1967 | Roth | 112/176 |
| 3,722,438 | A * | 3/1973 | Schinzel et al. | 112/199 |
| 3,881,434 | A | 5/1975 | Kelly | |
| 4,531,467 | A * | 7/1985 | Golia et al. | 112/155 |
| 5,253,600 | A | 10/1993 | Sugahara | |
| 6,470,814 | B2 * | 10/2002 | Keilmann | 112/176 |
| 7,918,171 | B2 * | 4/2011 | Miyoshi | 112/225 |

FOREIGN PATENT DOCUMENTS

| | | | |
|---|---|---|---|
| EP | 0 727 519 | A1 | 8/1996 |
| EP | 1 233 096 | A2 | 8/2002 |
| FR | 583 241 | A | 1/1925 |
| GB | 04467 | A | 3/1916 |
| WO | 99/56573 | A2 | 11/1999 |

OTHER PUBLICATIONS

International Search Report from corresponding International Application No. PCT/IB2010/00033 mailed Jun. 24, 2011.

* cited by examiner

*Primary Examiner* — Tejash Patel
(74) *Attorney, Agent, or Firm* — Greenberg Traurig, LLP

(57) ABSTRACT

One embodiment of the present invention relates to a machine for sewing, embroidering, quilting and/or the like. Another embodiment of the present invention relates to a method for sewing, embroidering, quilting and/or the like. In one example, the present invention may be applied (e.g., as a machine and/or method) to a multi-needle machine or method.

34 Claims, 28 Drawing Sheets

| NEEDLES POSITION | NEEDLE ROWS | WORKING WIDTH | CARRIAGE STROKE | STANDARD FEET | STICH LENGTH | WORKING SPEED |
|---|---|---|---|---|---|---|
| 100x3 1"PITCH | 3 3"–6" | cm.254 (100")+ cm.30 (12") | mm 305 12" | 64 1" | 1–6 mm | UP TO 1400 spm |

MACHINE AND METHOD FOR SEWING, EMBROIDERING, QUILTING AND/OR THE LIKE EMPLOYING CURVED SEWING NEEDLES WITH CORRESPONDING MOVEMENT OF NEEDLE BARS

RELATED APPLICATIONS

This application claims the benefit of U.S. Provisional Application Ser. No. 61/148,716, filed Jan. 30, 2009. The aforementioned application is incorporated herein by reference in its entirety.

FIELD OF THE INVENTION

One embodiment of the present invention relates to a machine for sewing, embroidering, quilting and/or the like.

Another embodiment of the present invention relates to a method for sewing, embroidering, quilting and/or the like.

In one example, the present invention may be applied (e.g., as a machine and/or method) to a multi-needle machine or method.

BACKGROUND OF THE INVENTION

Various machines for quilting, stitching and the like have been disclosed in various patent-related documents. Examples include the following: U.S. Pat. No. 3,680,507, issued Aug. 1, 1972 to Landoni (entitled "MULTINEEDLE QUILTING MACHINE"); U.S. Pat. No. 4,089,281, issued May 16, 1978 to Landoni (entitled "CONTROL DEVICE OF A NEEDLE-BEARING IN A QUILTING MACHINE"); U.S. Pat. No. 4,106,417, issued Aug. 15, 1978 to Landoni (entitled "APPARATUS FOR CONTROLLING THE MOVEMENT OF A FABRIC-SUPPORTING CARRIAGE IN A QUILTING MACHINE"); U.S. Pat. No. 4,262,613, issued Apr. 21, 1981 to Landoni (entitled "APPARATUS FOR CONTROLLING THE TRANSVERSE MOVEMENT OF A FABRIC SUPPORTING CARRIAGE IN A QUILTING MACHINE"); U.S. Pat. No. 4,501,208, issued Feb. 26, 1985 to Landoni (entitled "PROCESS FOR THE BIDIRECTIONAL FEEDING OF FABRICS IN QUILTING MACHINES, AND A MACHINE UTILIZING THIS PROCESS"); U.S. Pat. No. 5,005,499, issued Apr. 9, 1991 to Landoni (entitled "DEVICE FOR DISABLING AND ENABLING STITCHING NEEDLES IN A QUILTING MACHINE OR A MULTI-NEEDLE EMBROIDERY MACHINE"); U.S. Pat. No. 5,269,238, issued Dec. 14, 1993 to Landoni (entitled "QUILTING MACHINE LOOPERS WITH LINKAGE/PISTON DRIVEN THREAD CUTTERS"); U.S. Pat. No. 5,676,077, issued Oct. 14, 1997 to Landoni (entitled "MULTI-NEEDLE CHAIN STITCH SEWING MACHINE WITH THREAD SEVERING SYSTEM"); U.S. Pat. No. 5,967,068, issued Oct. 19, 1999 to Landoni (entitled "MULTI-NEEDLE KNOTTED-STITCH QUILTING MACHINE WITH LOWER STITCHING ELEMENTS HAVING ROTATING HOOKS"); U.S. Pat. No. 6,957,615, issued Oct. 25, 2005 to Landoni (entitled "METHOD AND DEVICE TO APPLY CORD THREAD OR RIBBONS ONTO FABRICS IN A QUILTING MACHINE"); U.S. Pat. No. Publication 2008/0245283, published Oct. 9, 2008 in the name of Landoni (entitled "AUTOMATIC MULTI-FUNCTION MULTI-NEEDLE SEWING MACHINE, AND RELATIVE SEWING METHOD"); and U.S. Pat. No. 7,591,227, issued Sep. 22, 2009 to Landoni (entitled "SYSTEMS AND METHODS FOR THREAD HANDLING AND/OR CUTTING").

Figure 1A:
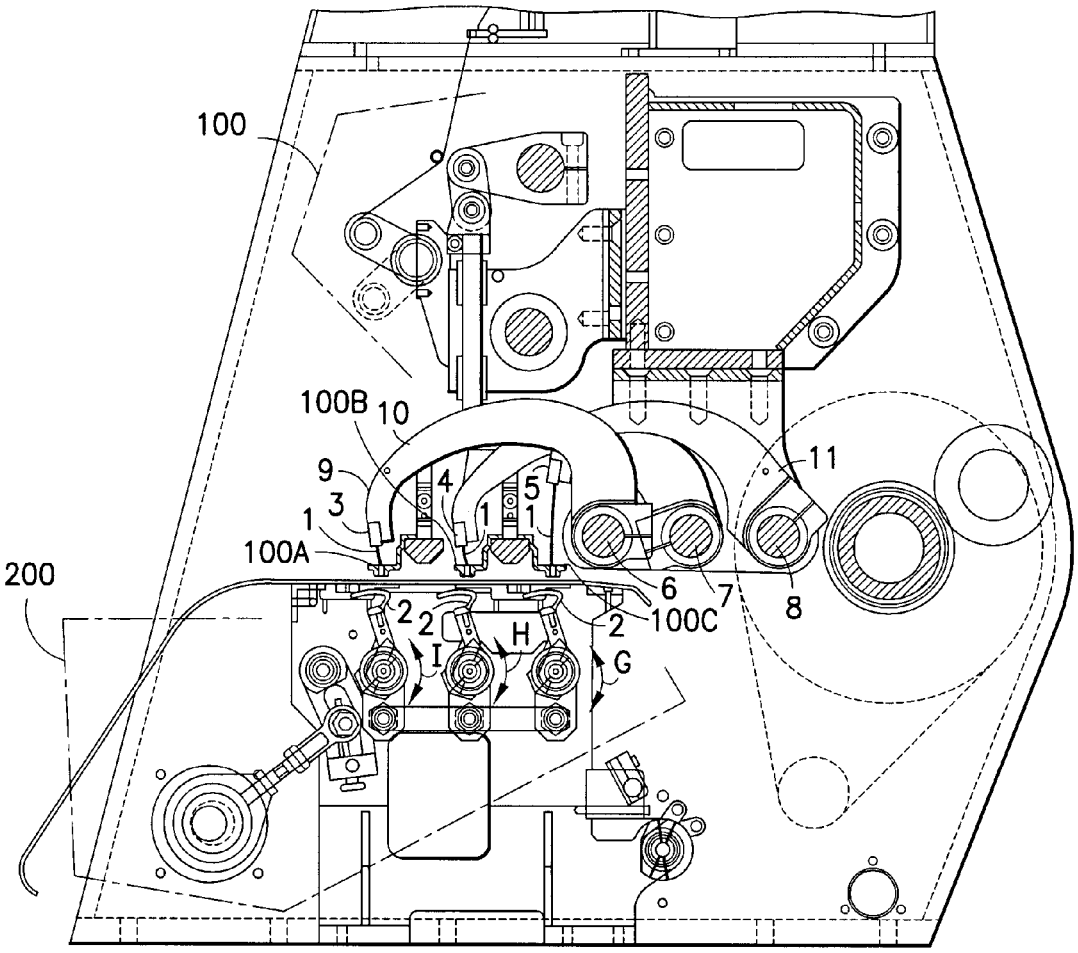
FIG. 1A shows a cross-sectional side view of a machine according to an embodiment of the present invention.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components (and any data, size, material and similar details shown in the figures are, of course, intended to be illustrative and not restrictive). Therefore, specific structural and functional details disclosed herein are not to be interpreted as limiting, but merely as a representative basis for teaching one skilled in the art to variously employ the present invention.

Of note, the application contains material that is subject to copyright protection. The copyright owner has no objection to the facsimile reproduction by anyone of the copyrighted material, as it appears in the Patent and Trademark Office file or records, but otherwise reserves all copyright rights whatsoever.

As described herein, in one embodiment the present invention may provide a multi-needle machine utilizing curved needles and/or independent movement of the needle bars.

Further, as described herein, in one example the present invention may be distinguished from certain conventional systems that, due to considerable inertia of the moving parts (and their complexity) present in such conventional systems, have various shortcomings, including (but not limited to):

- Relatively limited sewing speed
- Relatively high wear associated with sliding parts
- Impossible to control independently a plurality of needle bars
- Relatively high cost due to quantity and complexity of components Further, as described herein, in another embodiment the present invention may provide a multi-needle double chain stitch quilting machine in which the sewing needles are curved to fit a semicircular, oscillating-alternating movement of the needle bars.

Further, as described herein, in another embodiment the present invention may provide a machine that allows for higher sewing speed due (at least in part) to the lower inertia of the moving parts.

Further, as described herein, in another embodiment the present invention may provide a machine that allows independent control of two, three (or more) needle bars such that certain patterns (e.g., sewing patterns) that are typically impossible (or very difficult) to accomplish on certain conventional machines (e.g., without independently movable needle bars such that all needle bars are in movement) may be produced (e.g., produced relatively easily using an embodiment of the present invention).

Further, as described herein, in another embodiment the present invention may provide a machine that has reduced manufacturing costs.

Reference will now be made to the Figs.

Figure 1B:
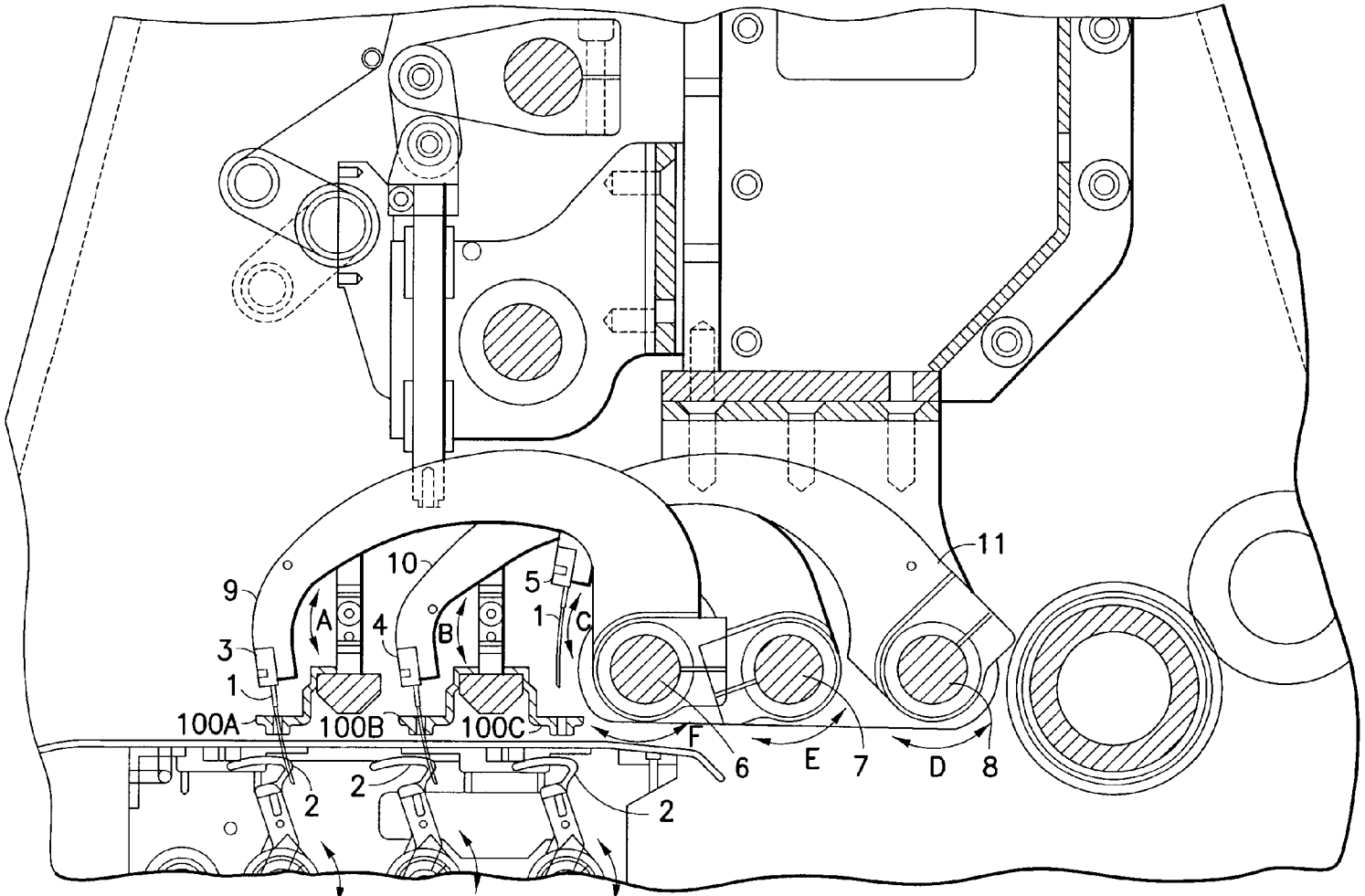
FIG. 1B shows various details associated with a portion of the machine as shown in FIG. 1A.

FIG. 1A shows a cross-sectional side view of a machine according to an embodiment of the present invention. Further, FIG. 1B shows various details associated with a portion of the machine as shown in FIG. 1A.

As seen in these FIGS. 1A and 1B, a free end of each of arms 9, 10, 11 is driven in this embodiment in a reciprocating manner in an arc (see arrows A,B,C of FIG. 1B which indicate the arcs along which the free ends of each of arms 9, 10, 11 is driven (the drive mechanism is discussed in more detail below). Of course, as the free ends of each of arms 9, 10, 11 is driven in an arc, each of needle bars 3,4,5 (which are attached, respectively, to arms 9, 10, 11) is also driven in an arc. Moreover, of course, as each of needle bars 3,4,5 is driven in an arc, each needle 1 is also driven in an arc (any desired number of needles may be attached to each needle bar).

In one example, one or more of the needles may be curved. In another example, all of the needles may be curved. In another example, at least one needle may have different radius of curvature than at least one other needle. In another example, all of the needles may have the same radius of curvature. In one specific example, a radius of curvature of a needle may be about 200 mm, in another example 100 mm, and in another example 50 mm.

Of note, in one embodiment, use of curved needles may provide for a lighter assembly that runs at a higher speed with a lower parts count.

Still referring to FIGS. 1A and 1B, it is seen that presser feet 100A,100B100C may be reciprocated (e.g., by a motor) up and down by the components generally identified in FIG. 1A as Portion 100.

Still referring to FIGS. 1A and 1B, it is seen that hooks 2 may be reciprocated (e.g., by a motor) by the components generally identified in FIG. 1A as Portion 200 (see arrows G,H,I of FIGS. 1A and 1B showing the movement of hooks 2 around their respective pivot points).

Thus, as seen, each of needles 1 may be driven in an arc to cooperate with hooks 2 and presser feet 100A,100B,100C to perform any desired sewing, embroidering, quilting and/or the like.

Of course, the various components may be driven (e.g., reciprocated) by one or more motor(s). In one example, a first motor may drive (e.g., reciprocate) arms 9, 10, 11; a second motor may drive (e.g., reciprocate) presser feet 100A,100B, 100C; and a third motor may drive (e.g., reciprocate) hooks 2. In another example, a single motor may drive (e.g., reciprocate) arms 9, 10, 11 and/or presser feet 100A,100B,100C and/or hooks 2.

Still referring to FIGS. 1A and 1B, it is seen that arms 9, 10, 11 may be reciprocated up and down in their respective arcs (e.g., circular arcs) by rotating rods 6,7,8 (the drive mechanism for rotating rods 6,7,8 is discussed in more detail below). More particularly, rotating rods 6,7,8 (which may be reciprocally rotated as shown by arrows D,E,F of FIG. 1B) may drive arms 9, 10, 11 due to each of arms 9,10,11 being attached to one of rotating rods 6,7,8.

Figure 2A:
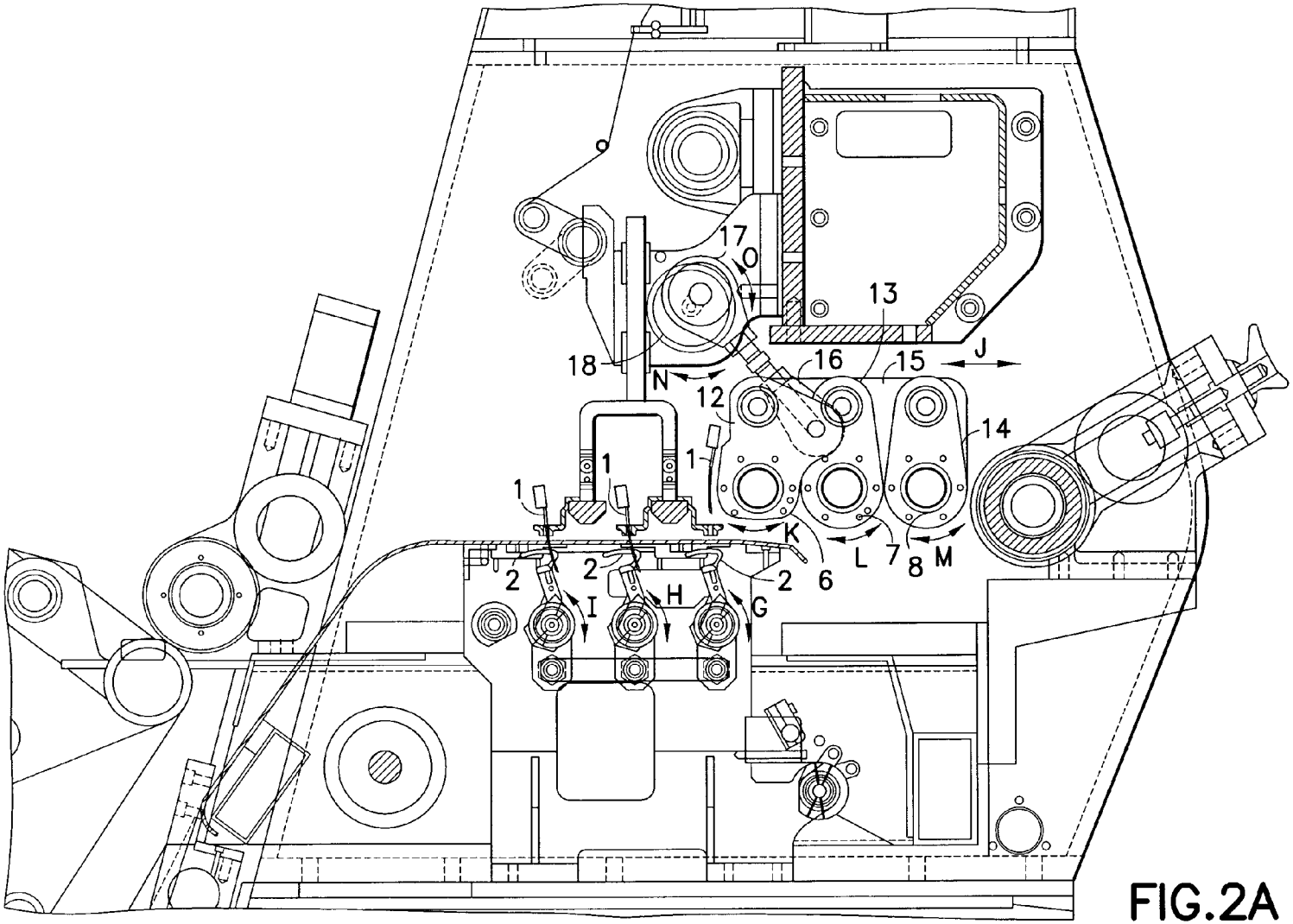
FIG. 2A shows a cross-sectional side view of the machine of FIG. 1A (this cross-sectional side view is taken at position different from the cross-sectional side view of FIG. 1A).
Figure 2B:
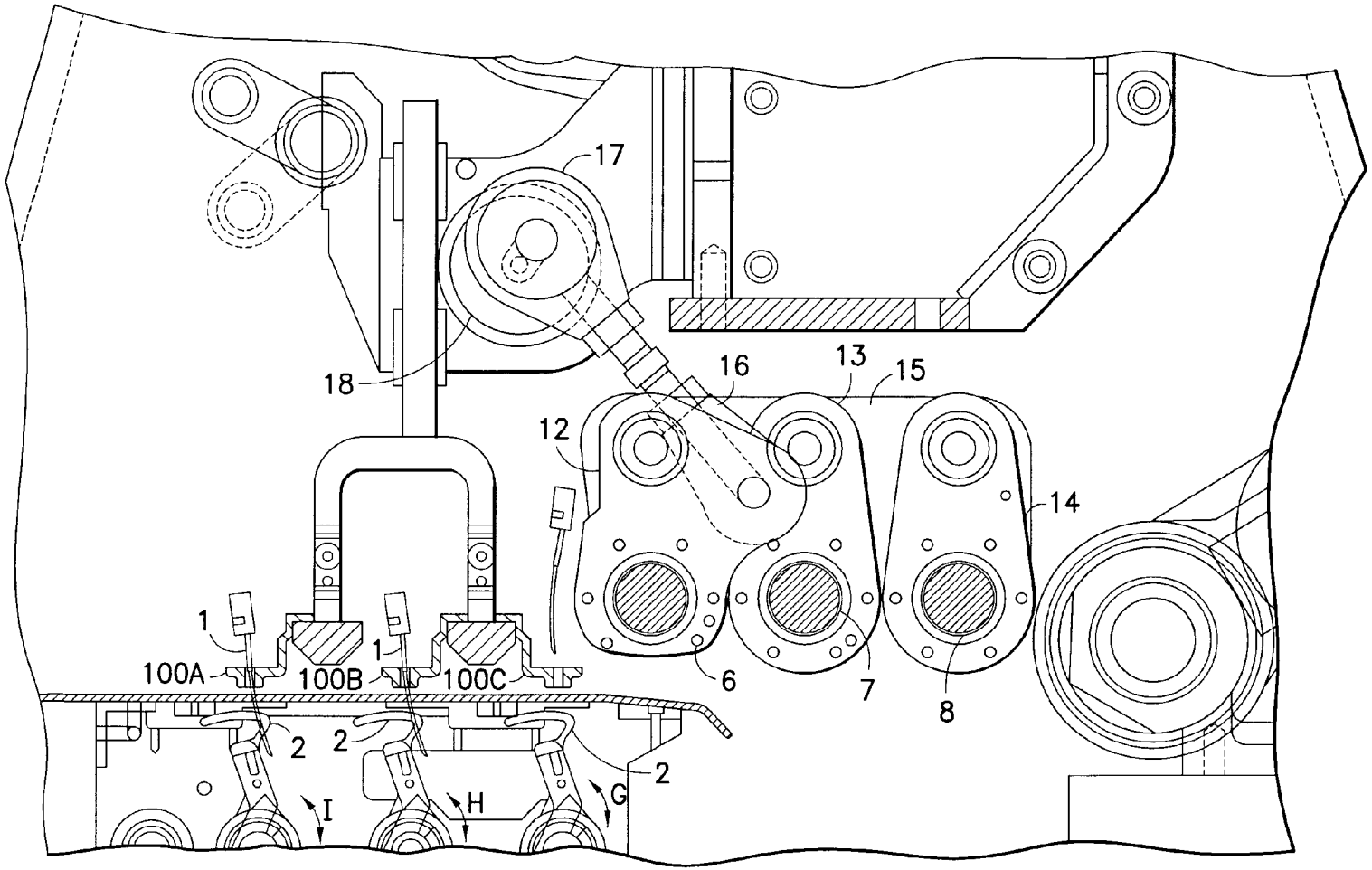
FIG. 2B shows various details associated with a portion of the machine as shown in FIG. 2A.
Figure 6:
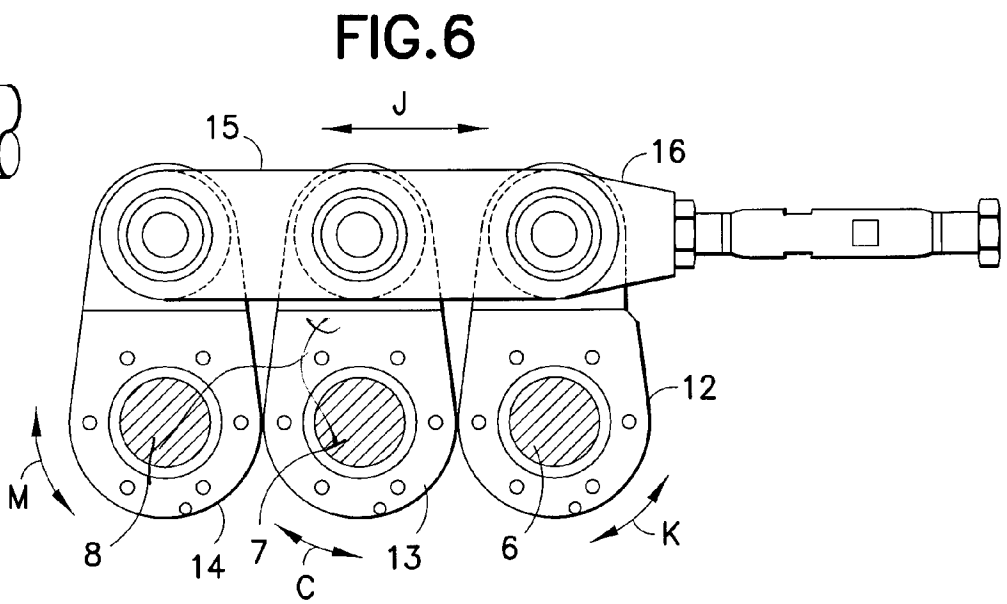
FIG. 6 shows various details associated with a portion of the machine as shown in FIGS. 2A and 2B.

Referring now to FIGS. 2A, 2B and 6, certain details regarding how rotating rods 6,7,8 are rotated back and forth as discussed above will be provided. More particularly, it is seen that each of rotating rods 6,7,8 has mounted thereto a respective connector element 12,13,14 (in one example, each of connector elements 12, 13,14 may comprise a clamp of the type discussed in more detail below). In addition, each of connector elements 12,13,14 is connected to tie bar 15 (such that the connector elements move together (see, e.g., FIGS. 2A and 6 where is seen that as tie bar 15 reciprocates along arrow J (in an essentially linear movement), each of rotating rods 6,7,8 is driven (by one of connector elements 12,13,14 when the respective clamp is engaged) to rotate back and forth (e.g., in a circular arc) as seen by arrows K,L,M).

Further, it is seen that tie bar 15 is driven to reciprocate along arrow J by the action of drive bar 16 (operatively connected at one end to connector element 12 and at the other end to eccentric 17). Of course, eccentric 17 converts the rotary motion shown by arrow N into the motion shown by arrow O associated with drive bar 16 (in one example, the rotation associated with eccentric 17 may be a back-and-forth rotation; in another example, the rotation associated with eccentric 17 may be a rotation in a single direction).

Again, various components may be driven by one or more motors (e.g., eccentric 17 may be driven by a motor to cause the various movements described above).

In one example, each of connector elements 12,13,14 may be clamped to each rotating rod 6,7,8 such that each clamp may be engaged (thus engaging the respective rotating rod 6,7,8, to cause the respective rotating rod 6,7,8 to reciprocate along with the respective connector element 12,13,14) or disengaged (thus disengaging the respective rotating rod 6,7,8 to allow the respective rotating rod 6,7,8 to not reciprocate along with the respective connector element 12,13,14). In another example, each clamp may be hydraulically and/or pneumatically activated (that is, engaged/disengaged). In another example, each clamp may be activated (that is, engaged/disengaged) under computer control.

In another example, each clamp may be activated (that is, engaged/disengaged) together (that is, all of the arms may be driven to reciprocate at one time). In another example, each clamp may be activated (that is, engaged/disengaged) independently (that is, one or more of the arms may be driven to reciprocate at one time while one or more other arms may not be driven to reciprocate at that time).

Figure 5:
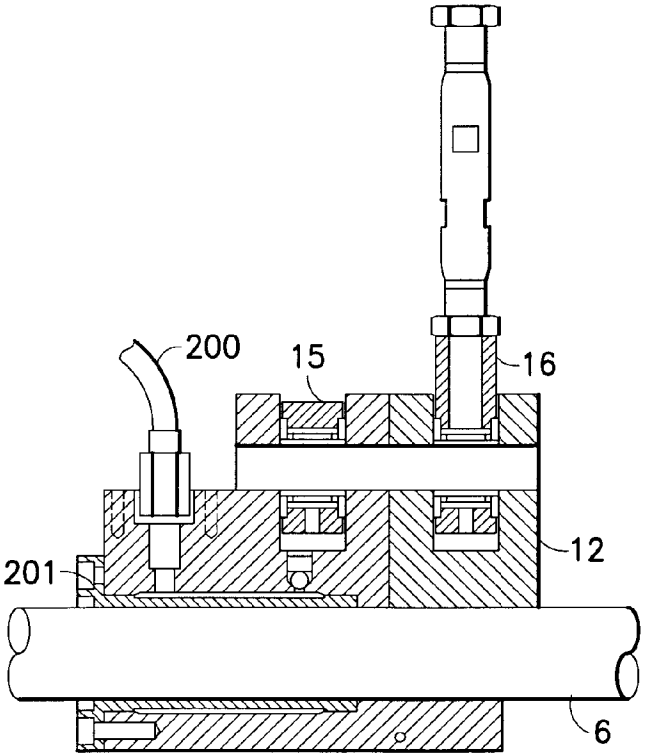
FIG. 5 shows various details associated with a portion of the machine as shown in FIG. 3.

Referring now to FIG. 5, certain additional details regarding a clamp of the type discussed above is shown (see, e.g., line 200 (which may carry hydraulic and/or pneumatic material (e.g., fluid, air, gas) and contact element 201 (comprising, for example, a clutch element or the like)).

Figure 3:
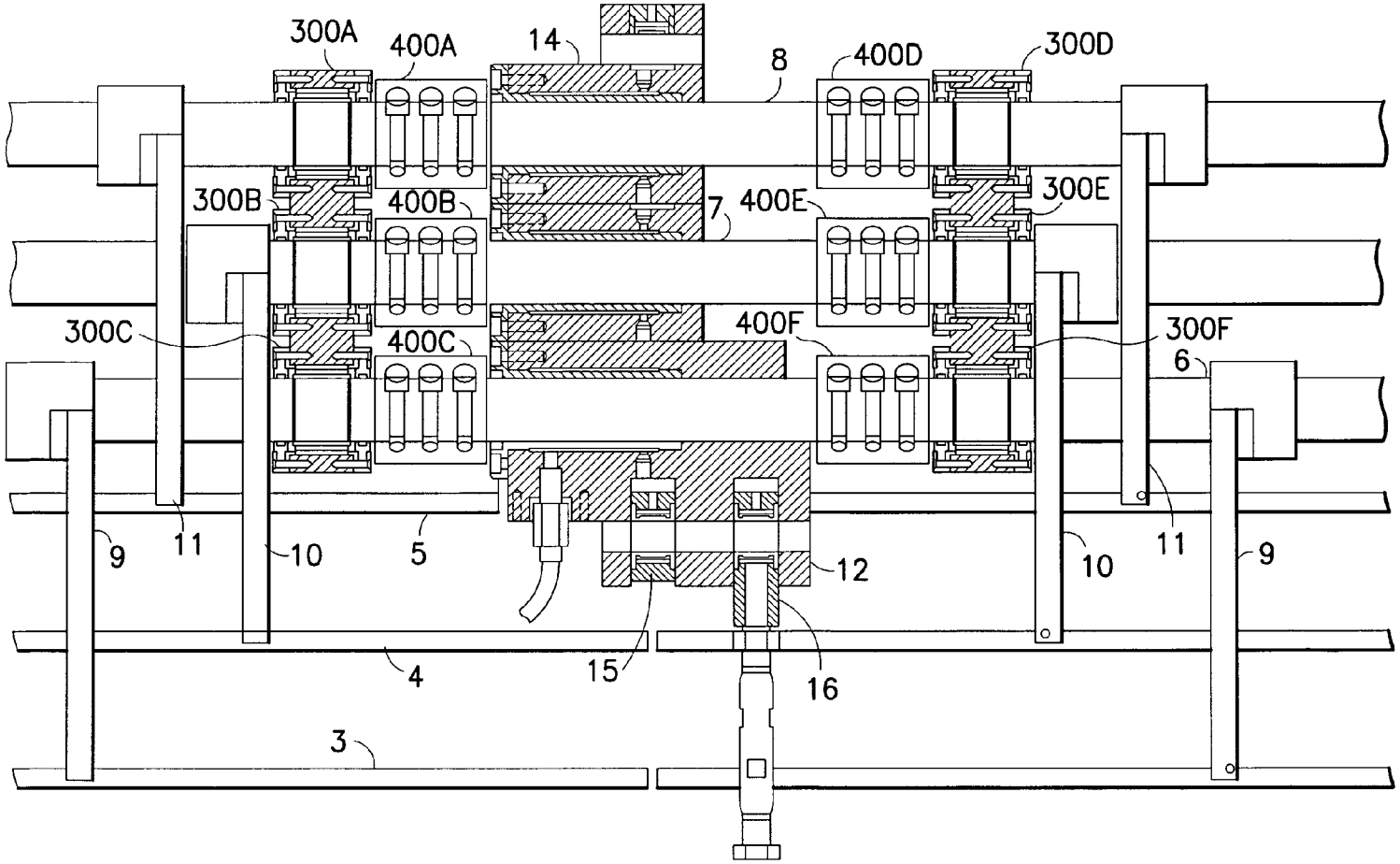
FIG. 3 shows a plan view of a portion of the machine of FIGS. 1A, 1B, 2A and 2C.

Referring now to FIG. 3, it is seen that various bearings may be utilized as desired (see, e.g., the example bearings 300A-300F of FIG. 3). Further, it is seen that, for example, connectors 400A-400F may be utilized to permit quick replacement of a component without removing an entire rotating rod (for example, connector element 12 may be removed and replaced by disconnecting elements 400C and 400F from rotating rod 6).

Figure 4:
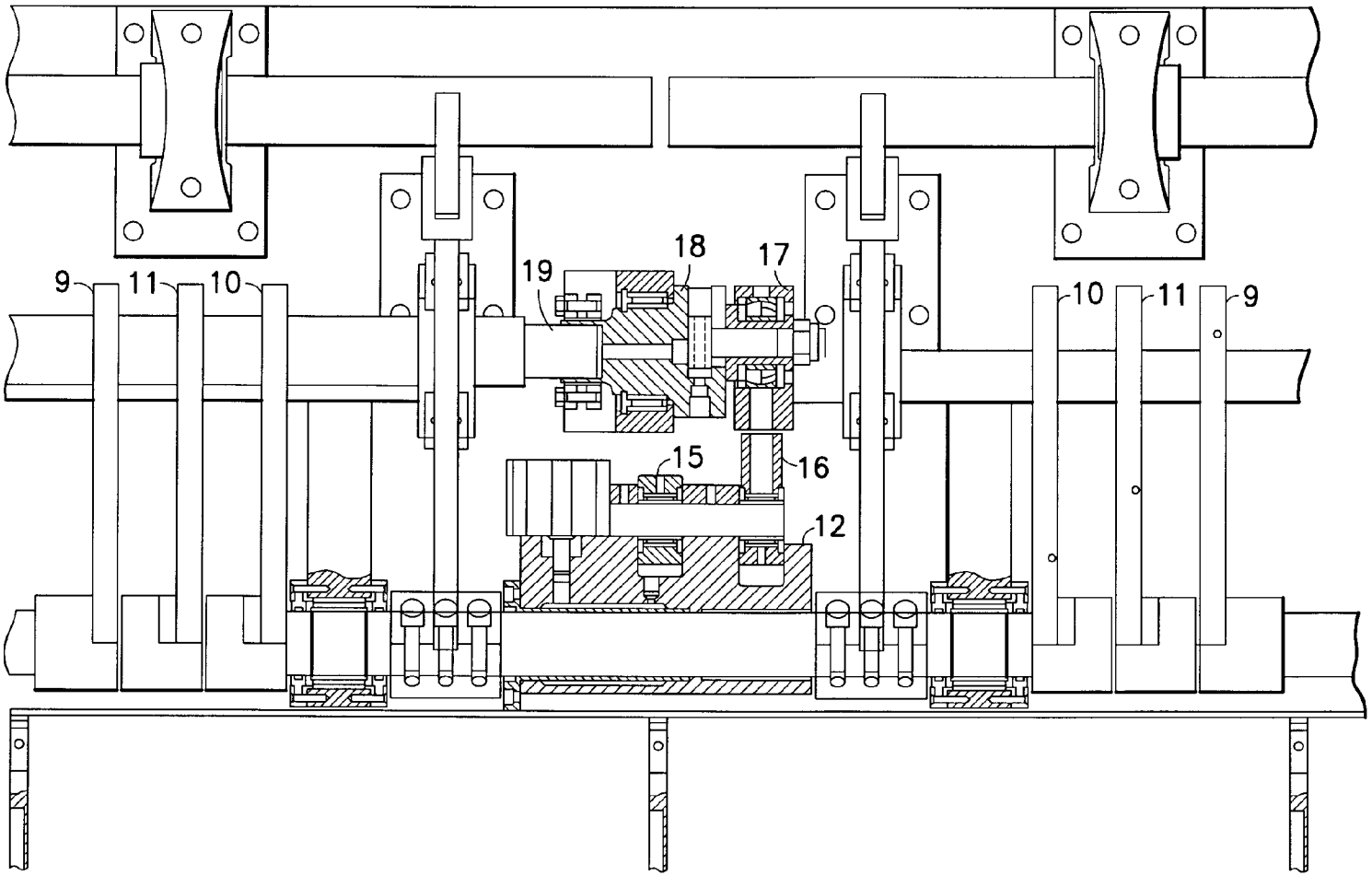
FIG. 4 shows a front view of a portion of the machine of FIGS. 1A, 1B, 2A and 2C.

Referring now to FIG. 4, this Fig. shows a front view of a portion of the machine of FIGS. 1A, 1B, 2A and 2B.

Figure 7A:
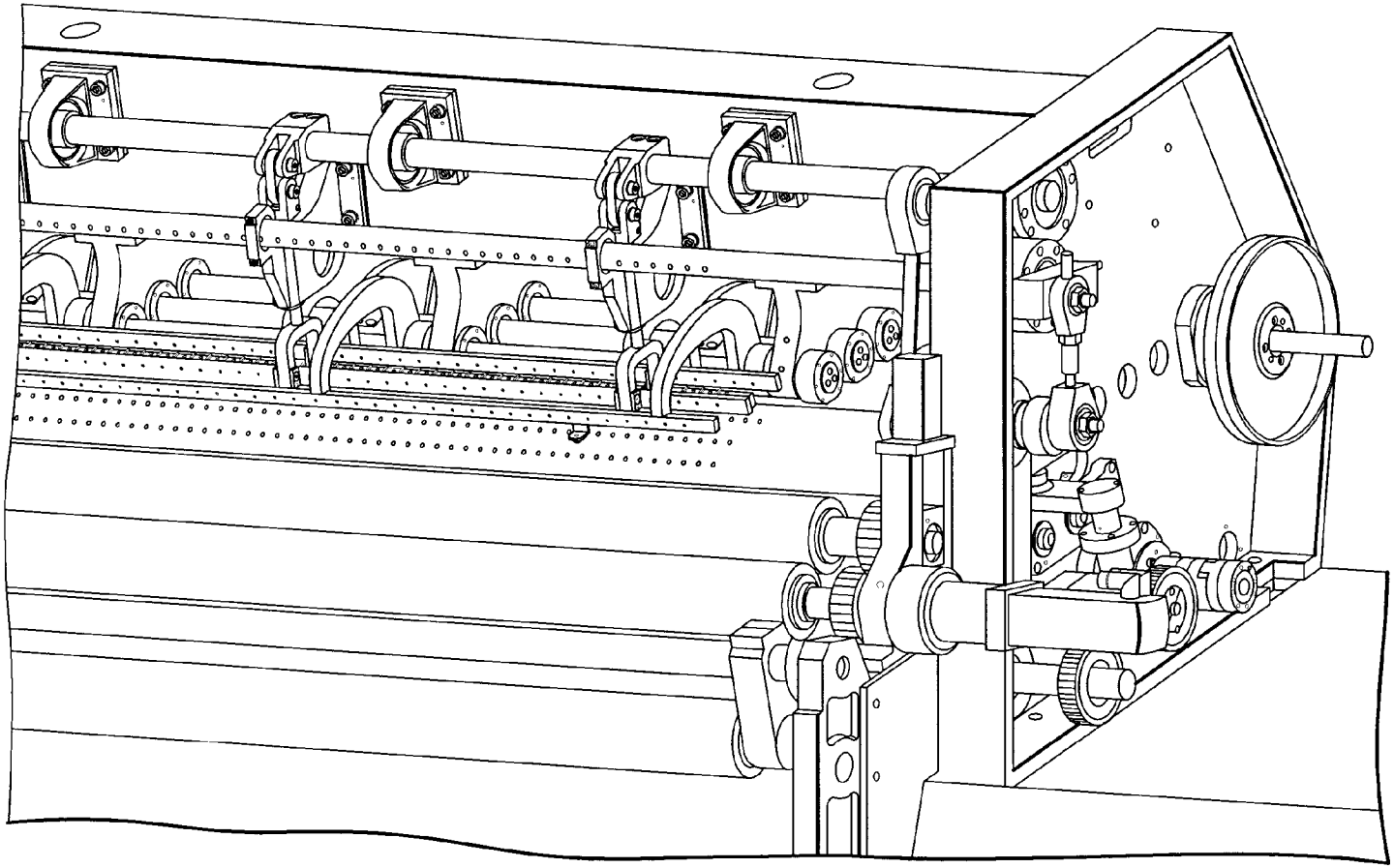
FIG. 7A shows a perspective view of a portion of the machine of FIGS. 1A, 1B, 2A and 2B.

Referring now to FIG. 7A, this Fig. shows a perspective view of a portion of the machine of FIGS. 1A, 1B, 2A and 2B.

Figure 7B:
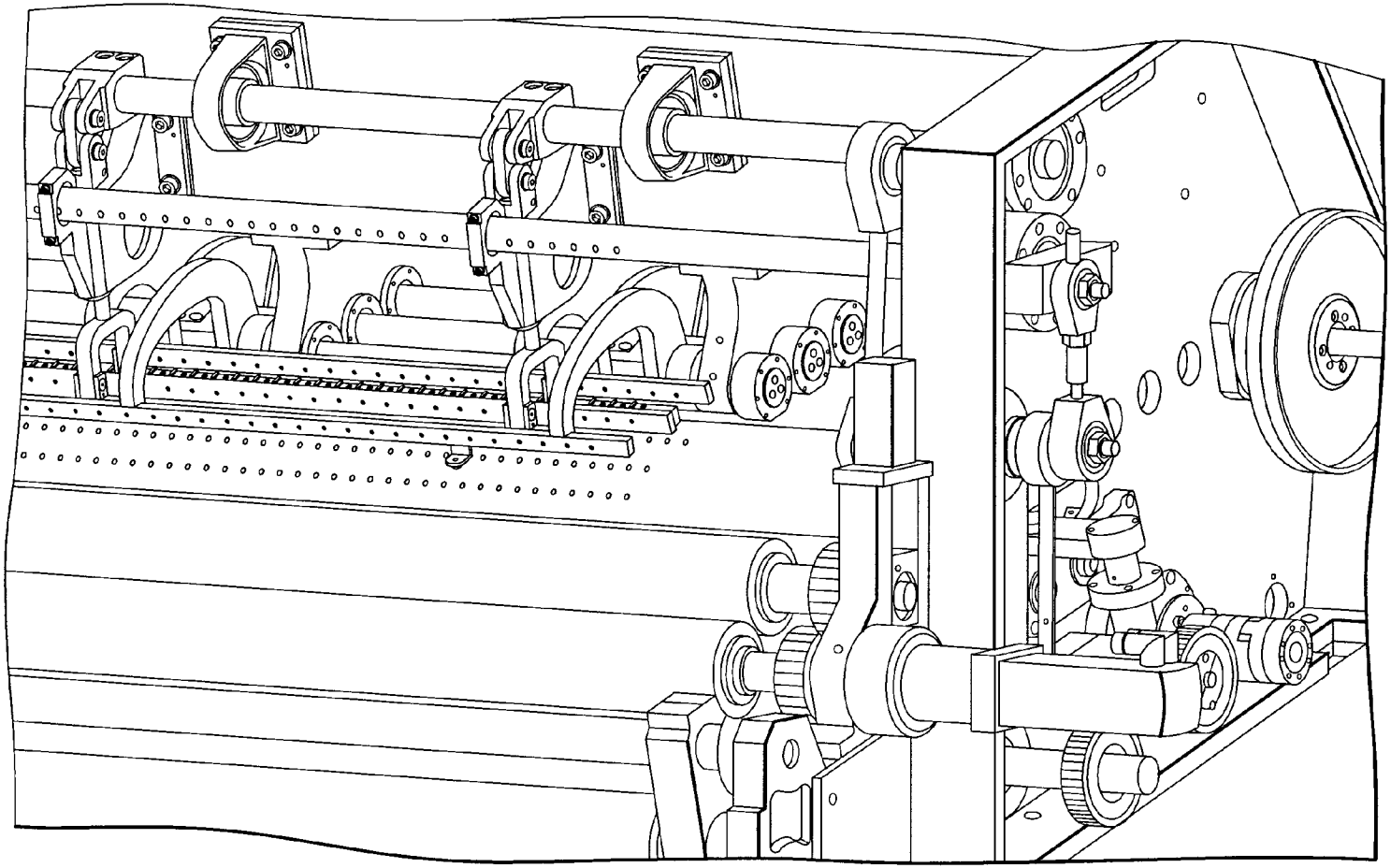
FIG. 7B shows various details associated with a portion of the machine as shown in FIG. 7A.

Referring now to FIG. 7B, this Fig. shows various details associated with a portion of the machine as shown in FIG. 7A.

Figure 8A:
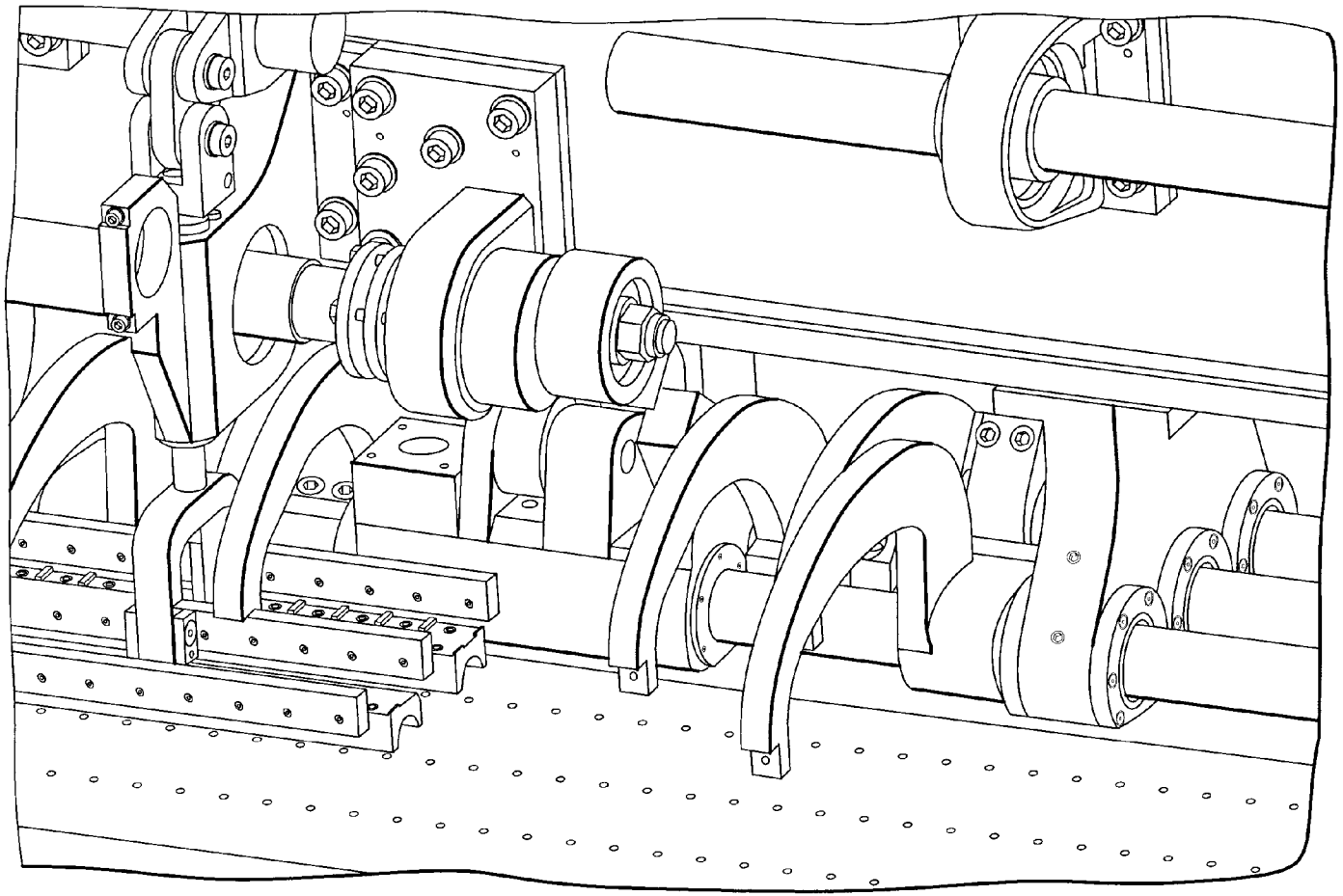
FIG. 8A shows another perspective view of a portion of the machine of FIGS. 1A, 1B, 2A and 2B.

Referring now to FIG. 8A, this Fig. shows another perspective view of a portion of the machine of FIGS. 1A, 1B, 2A and 2B.

Figure 8B:
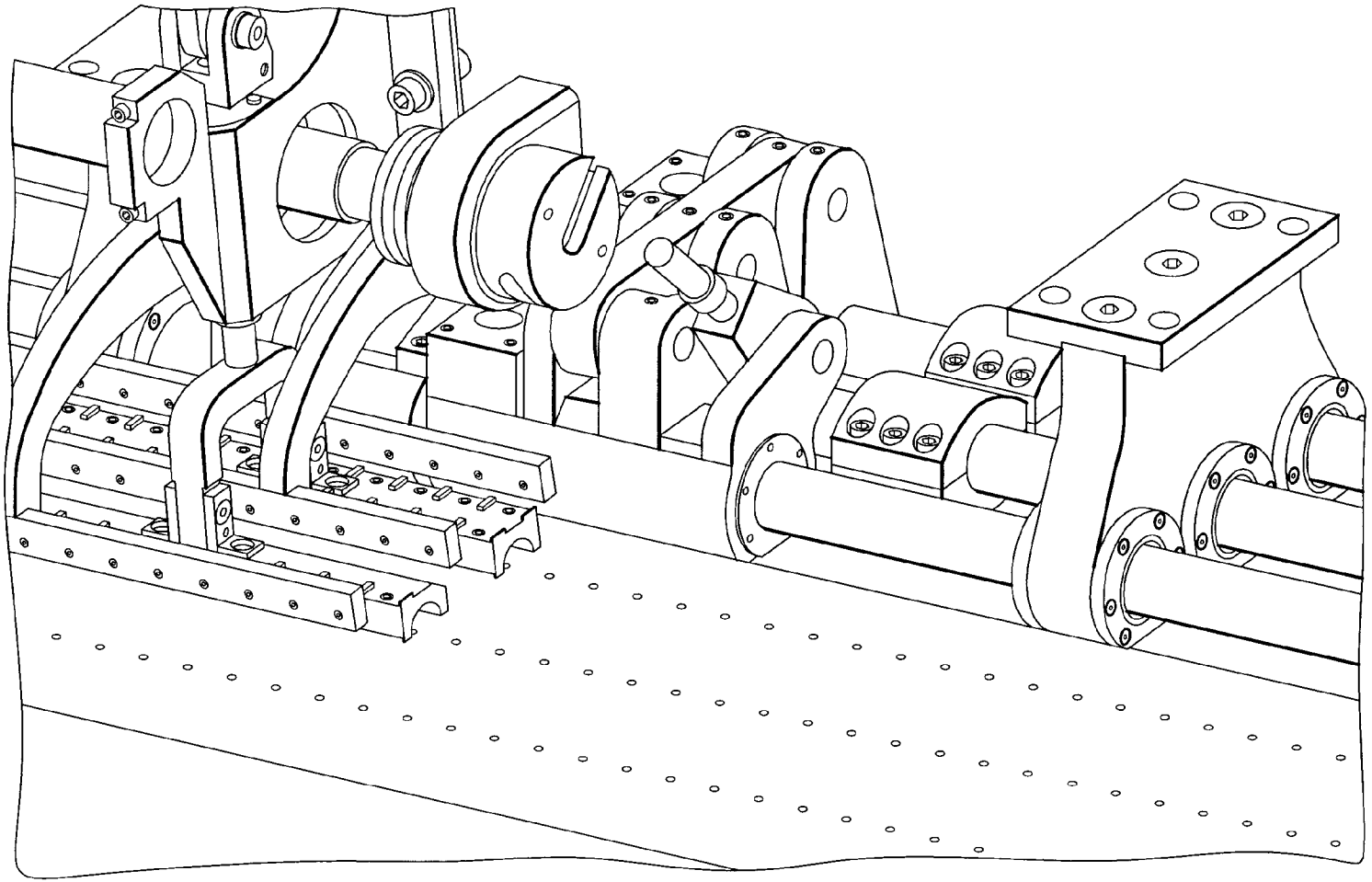
FIG. 8B shows another perspective view of a portion of the machine of FIGS. 1A, 1B, 2A and 2B (this view is similar to the view of FIG. 8A, but with certain parts removed to show other parts).

Referring now to FIG. 8B, this Fig. shows another perspective view of a portion of the machine of FIGS. 1A, 1B, 2A and 2B (this view is similar to the view of FIG. 8A, but with certain parts removed to show other parts).

Figure 9:
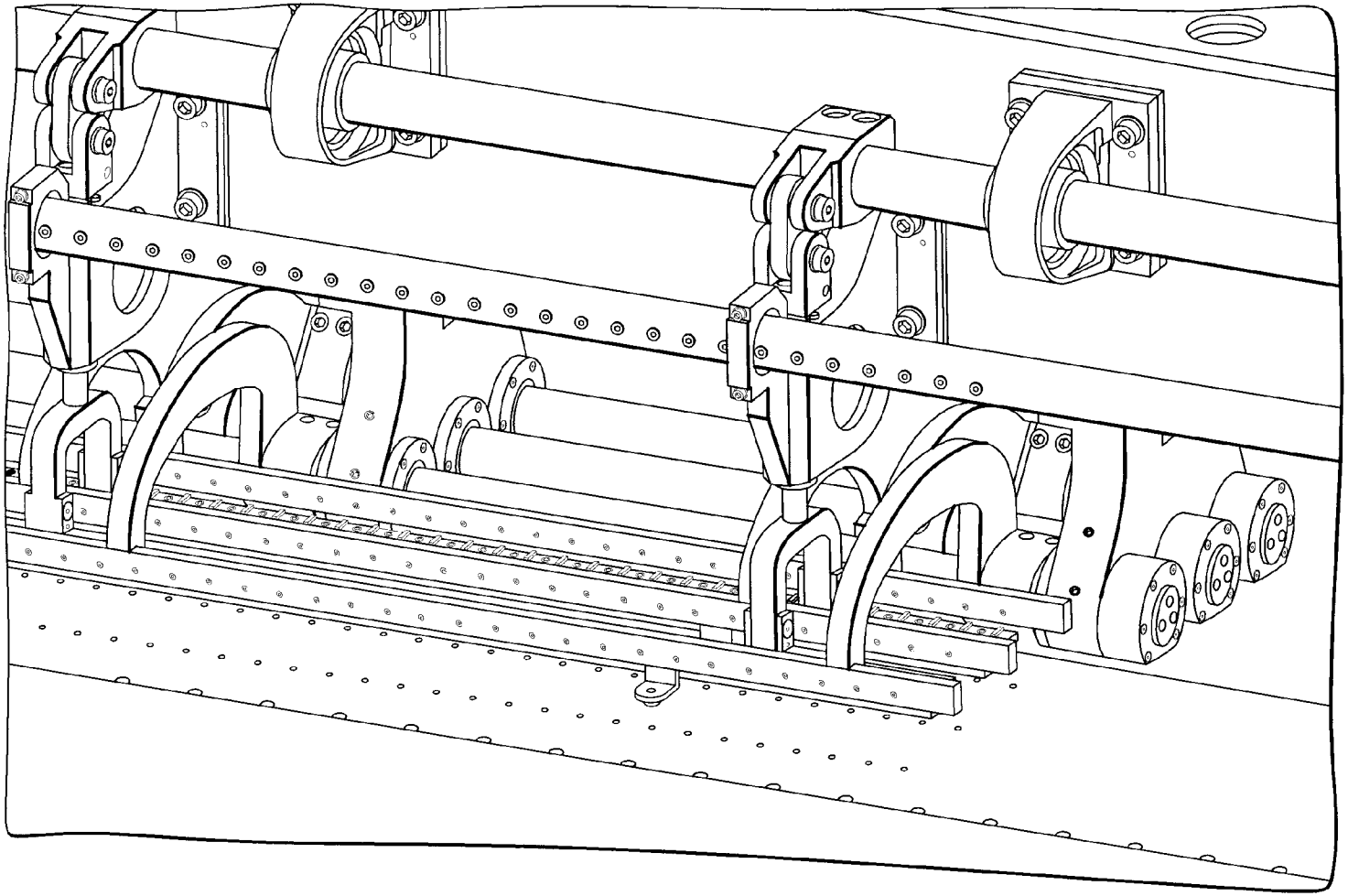
FIG. 9 shows another perspective view of a portion of the machine of FIGS. 1A, 1B, 2A and 2B.

Referring now to FIG. 9, this Fig. shows another perspective view of a portion of the machine of FIGS. 1A, 1B, 2A and 2B.

Figure 10:
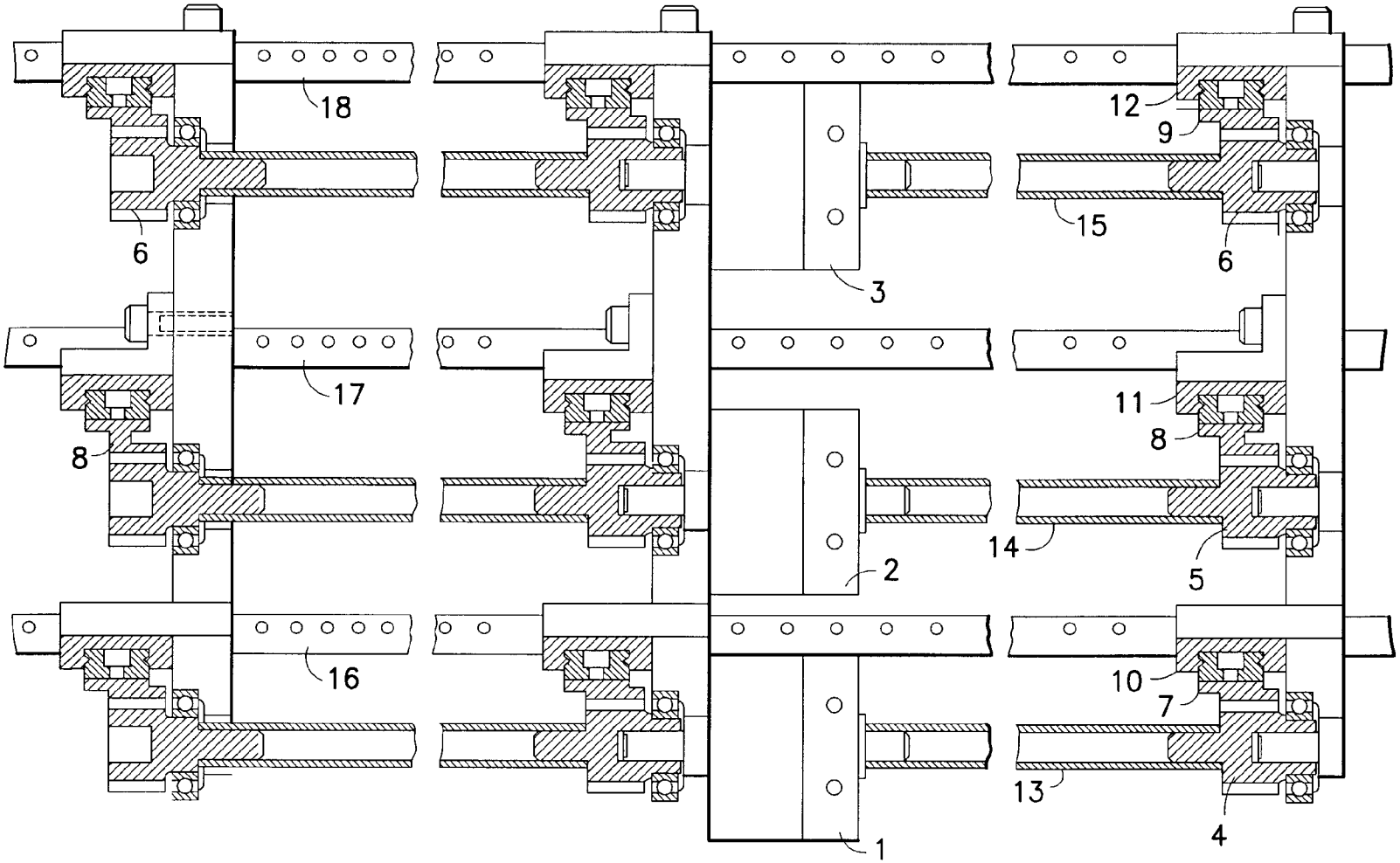
FIG. 10 shows a plan view of a portion of a machine with independent needle bars according to another embodiment of the present invention.
Figure 11:
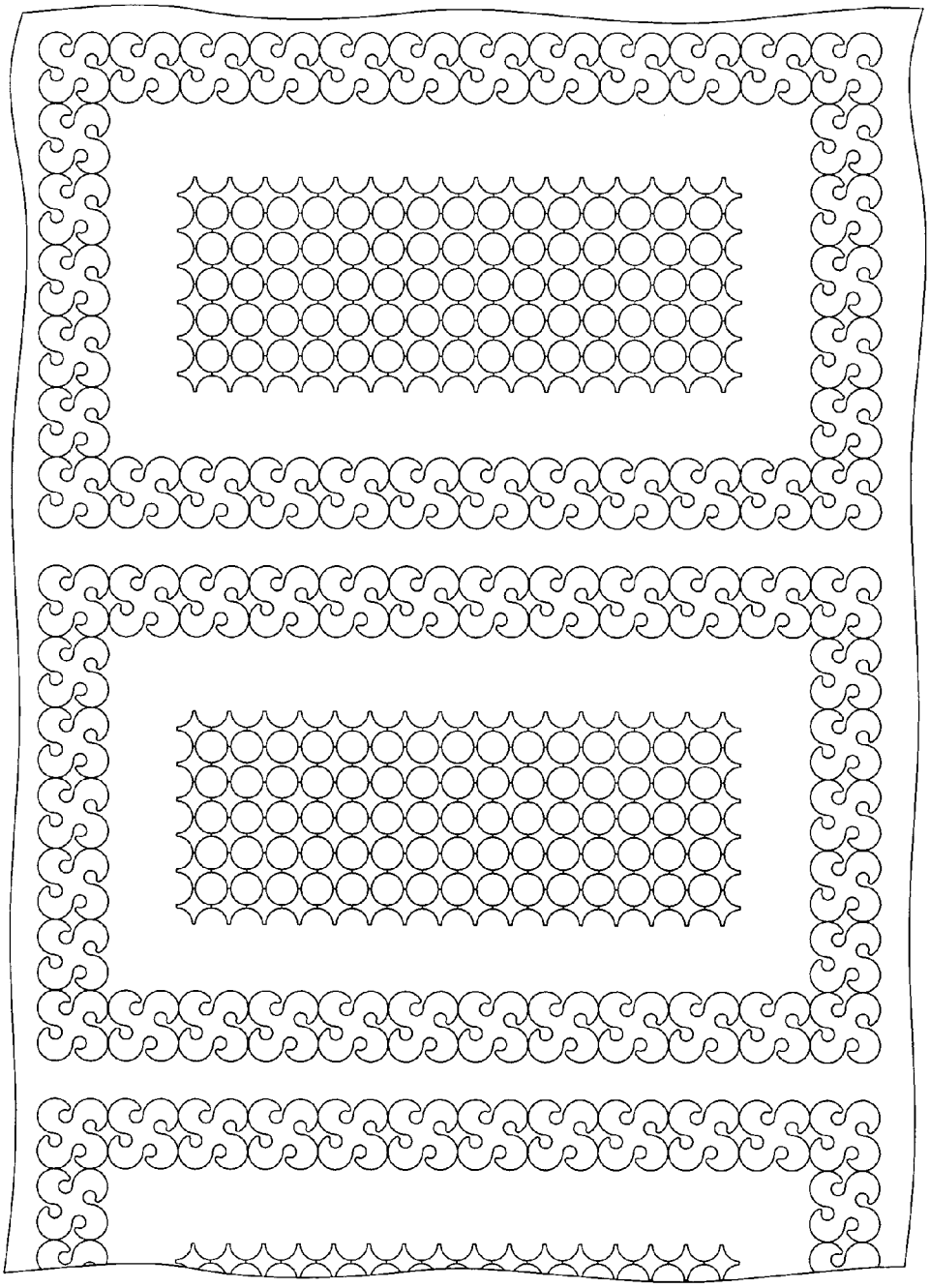
FIGS. 11-18 show views of various example patterns that may be produced using various embodiments of the present invention.
Figure 12:
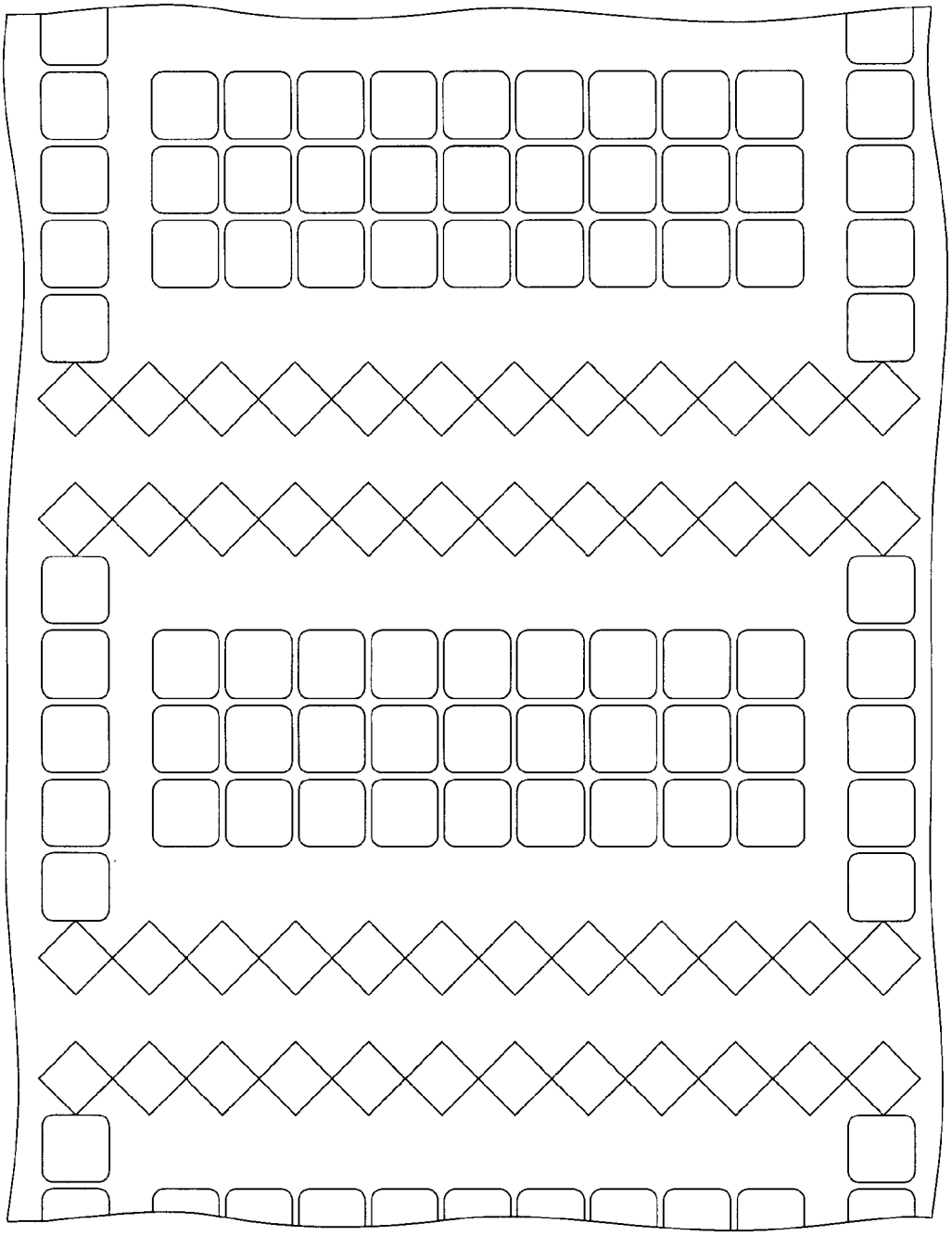
Figure 13:
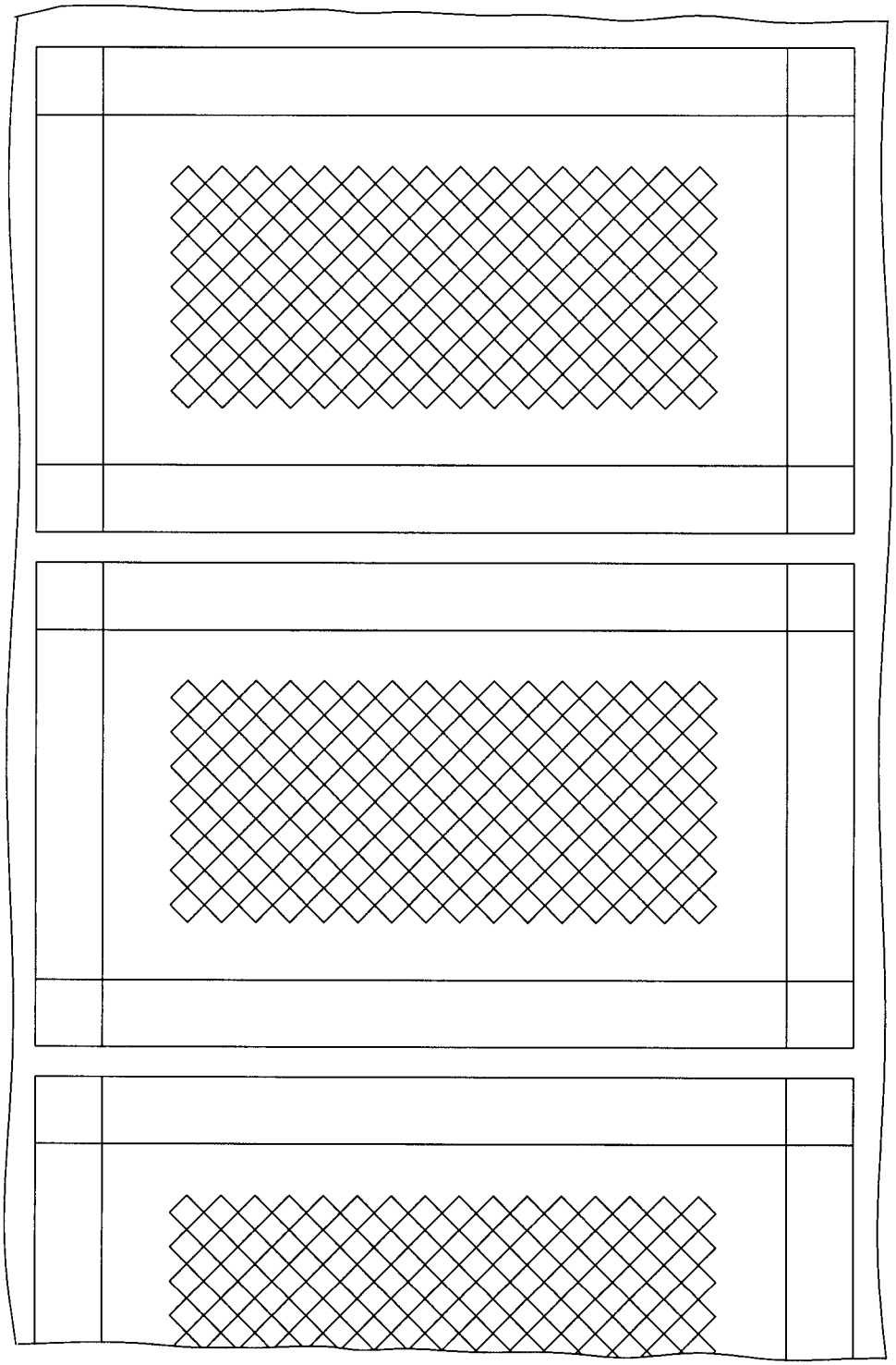
Figure 14:
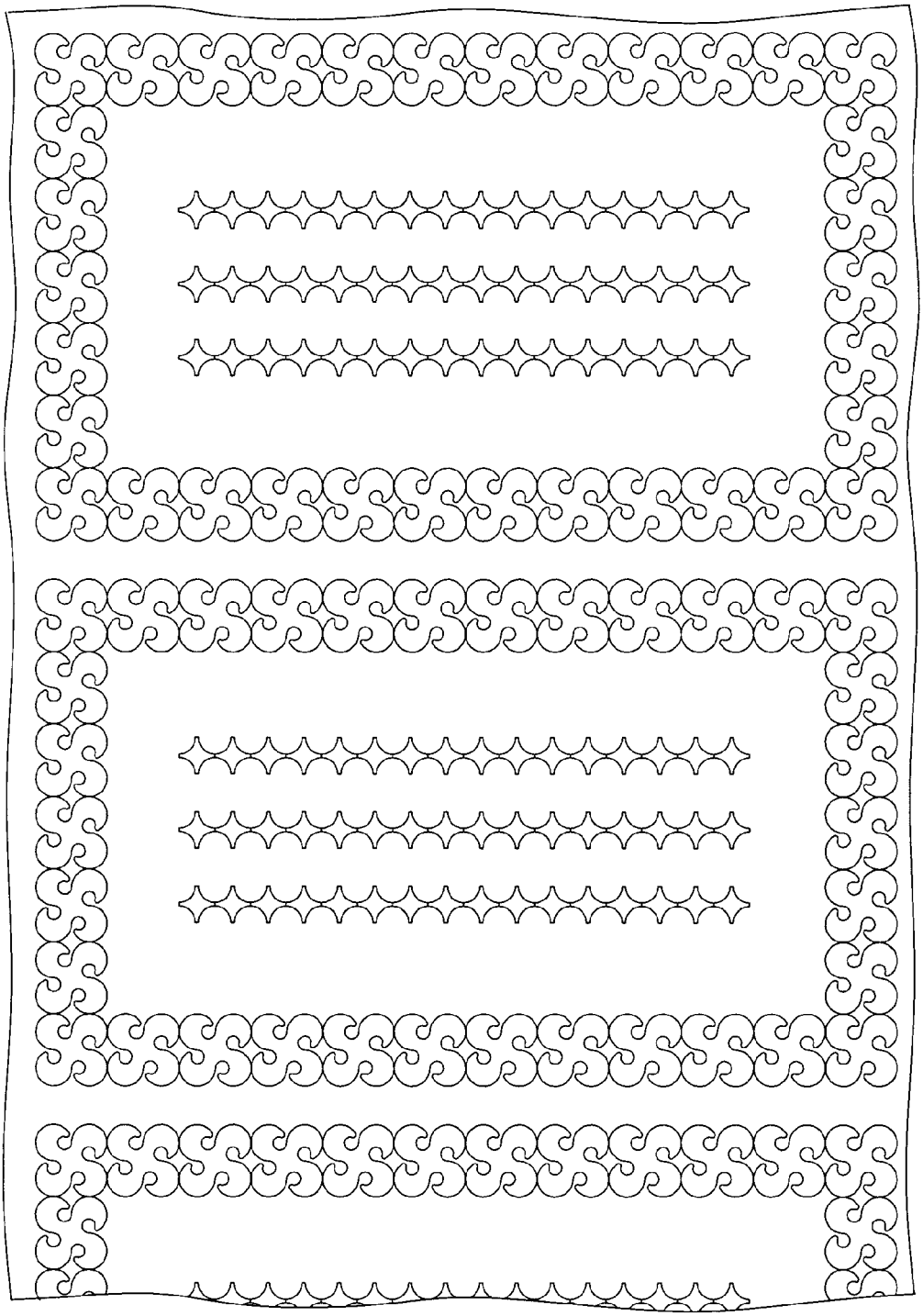
Figure 15:
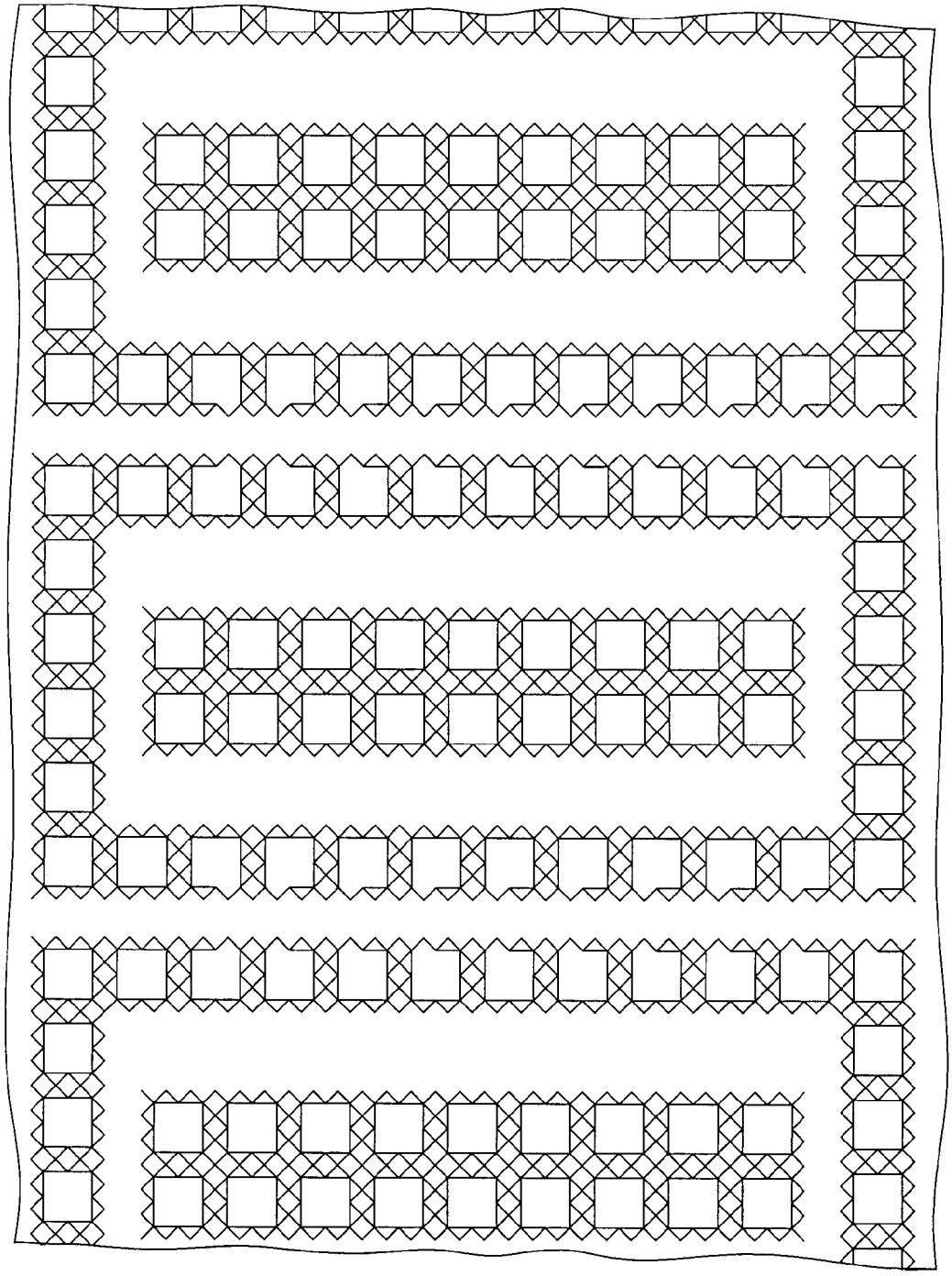
Figure 16:
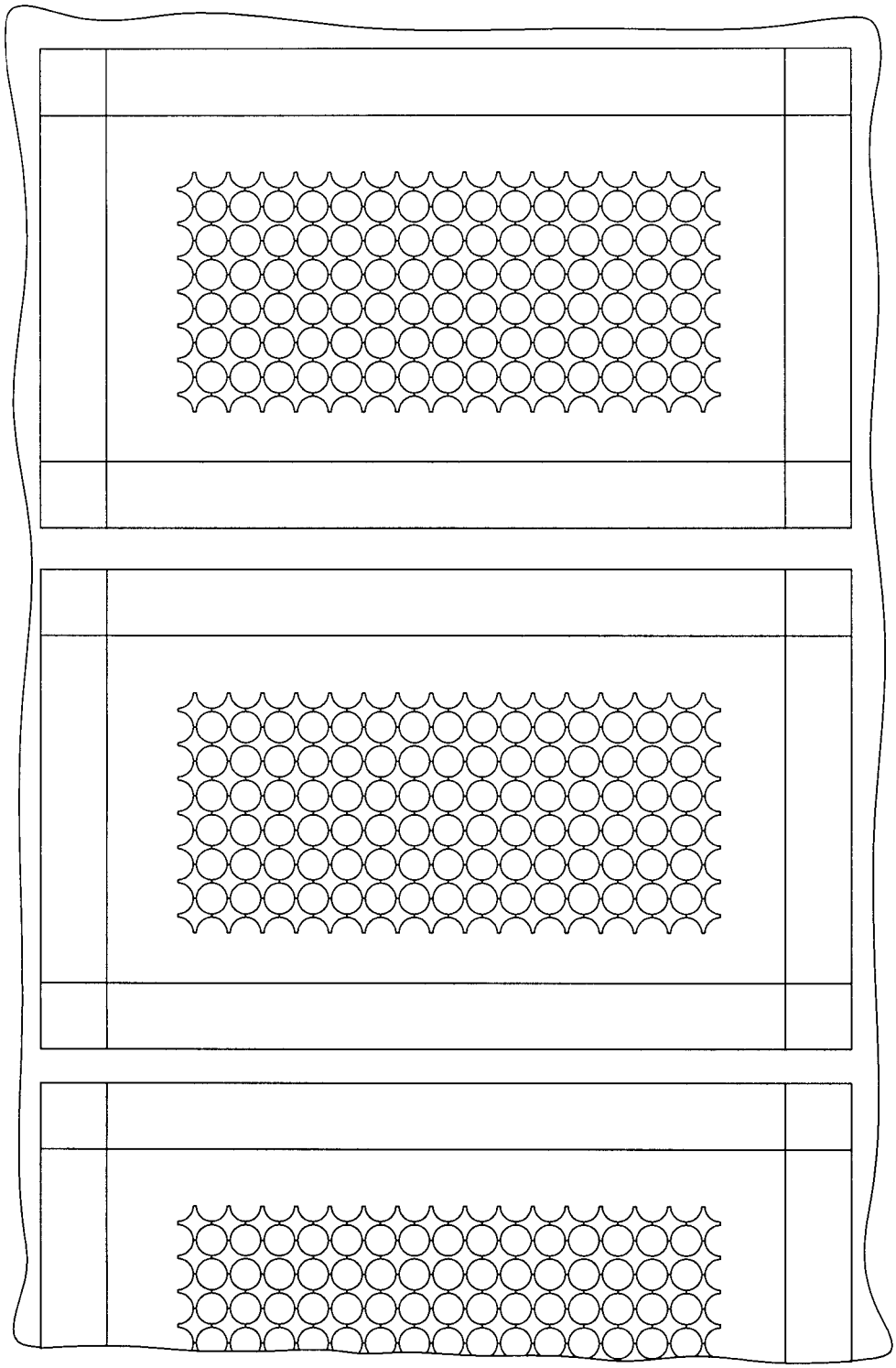
Figure 17:
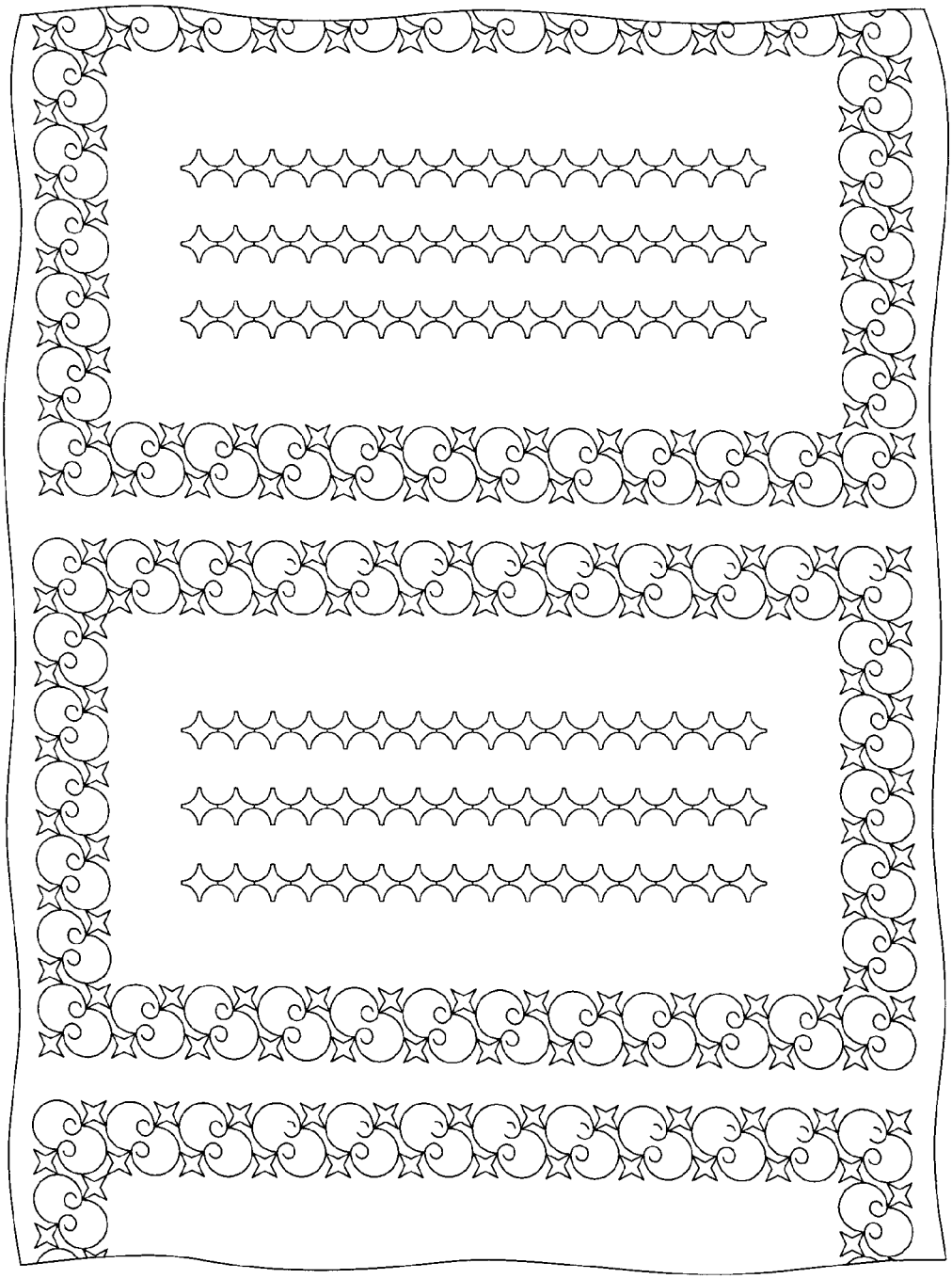
Figure 18:
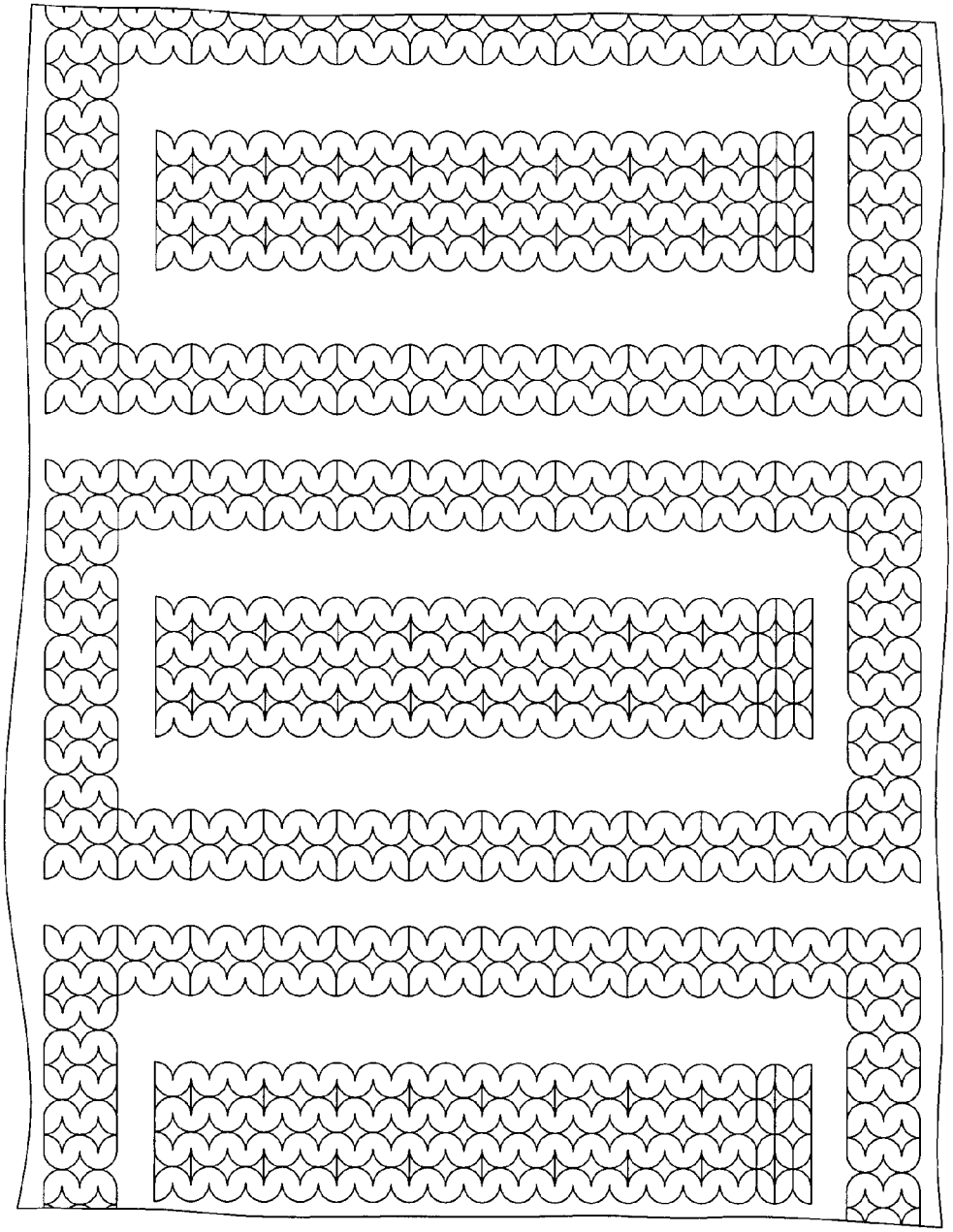
Figure 20:
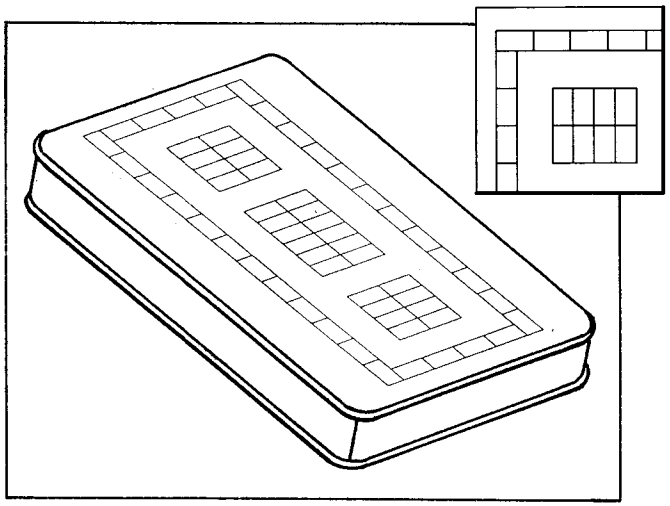
FIGS. 19-22 show views of additional various example patterns that may be produced using various embodiments of the present invention (each of these Figs. shows an example pattern on a mattress, along with a detail view of a portion of the associated pattern).
Figure 19:
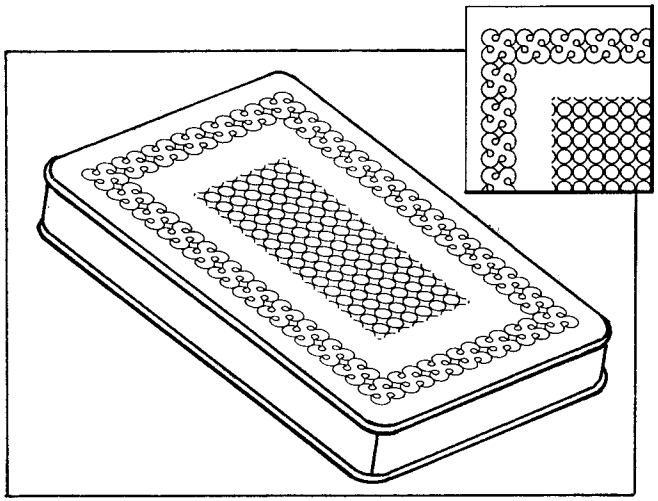
Figure 22:
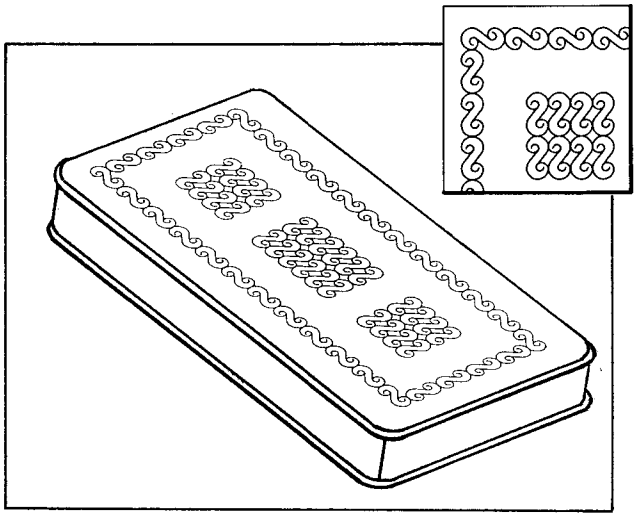
Figure 21:
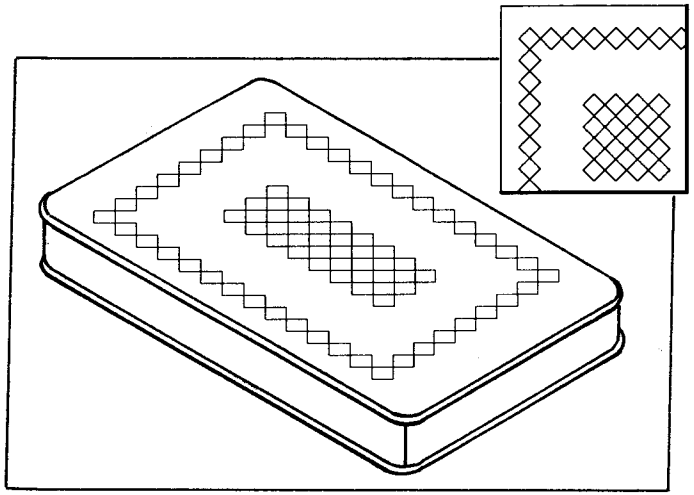
Figure 23:
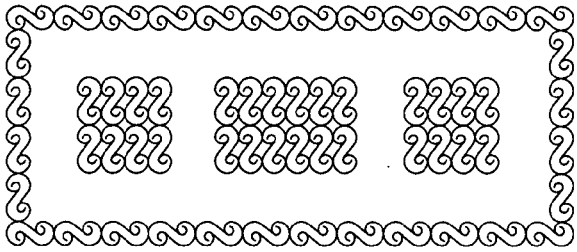
FIGS. 23-29 show views of additional various example patterns that may be produced using various embodiments of the present invention.
Figure 24:
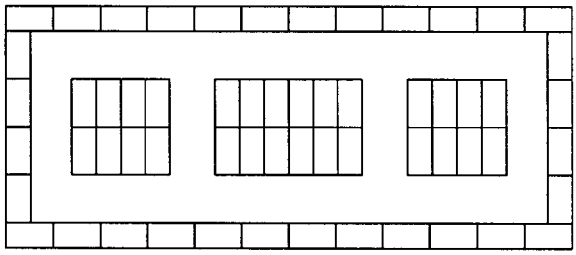
Figure 25:
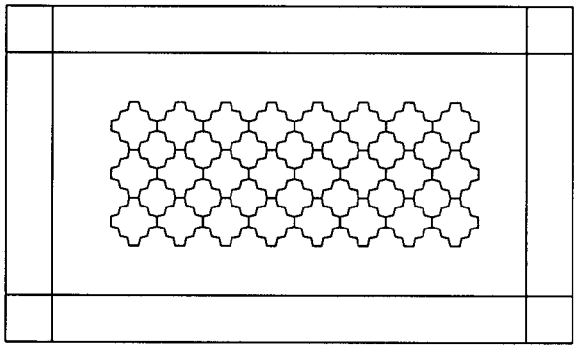
Figure 26:
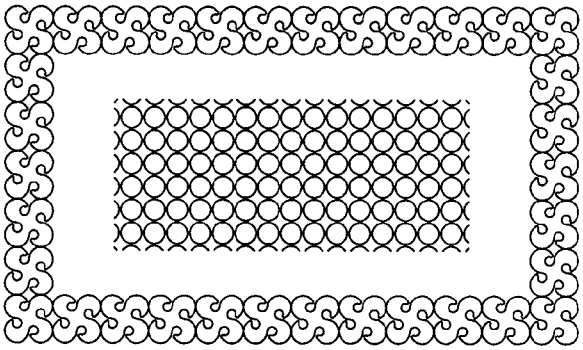
Figure 27:
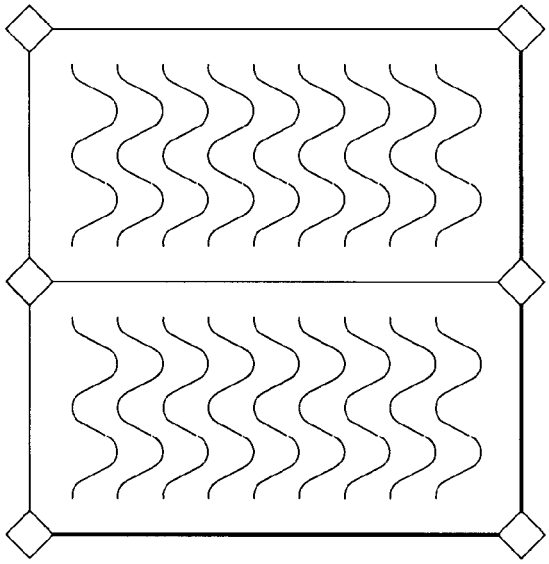
Figure 28:
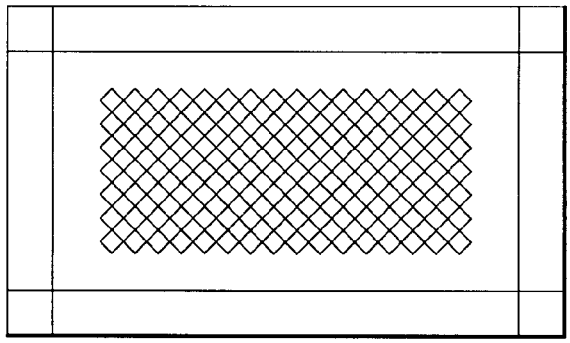
Figure 29:
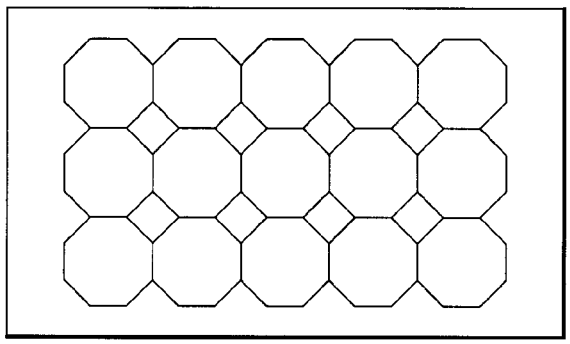
Figure 32:
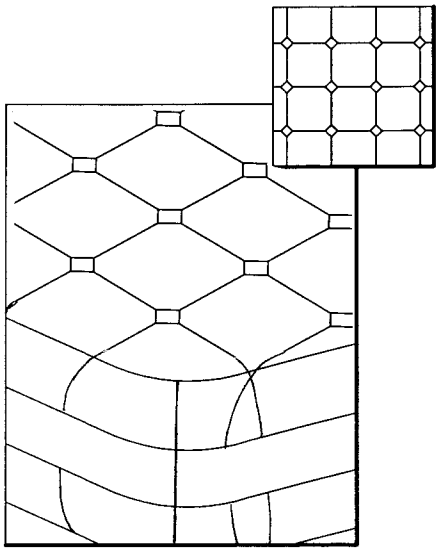
FIGS. 30-32 show views of additional various example patterns that may be produced using various embodiments of the present invention (each of these Figs. shows an example pattern on a mattress, along with a detail view of a portion of the associated pattern).
Figure 31:
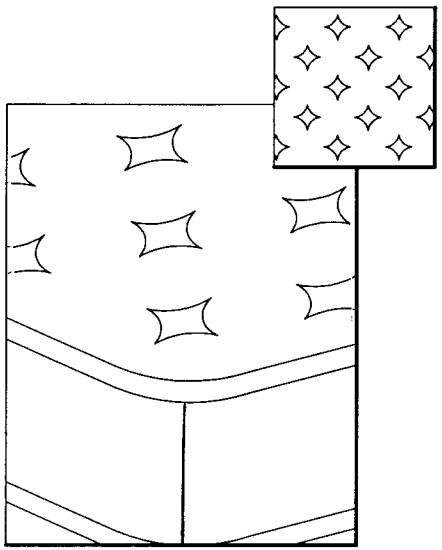
Figure 30:
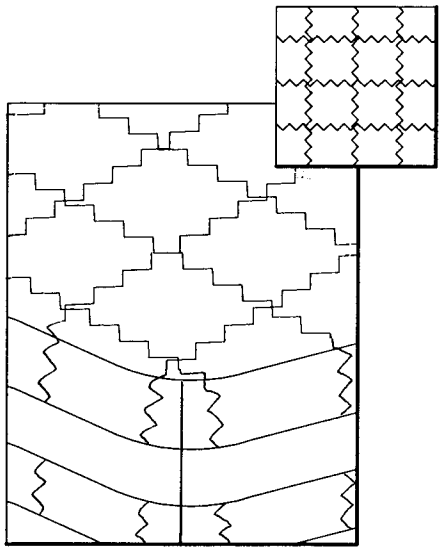
Figures 33, 34:
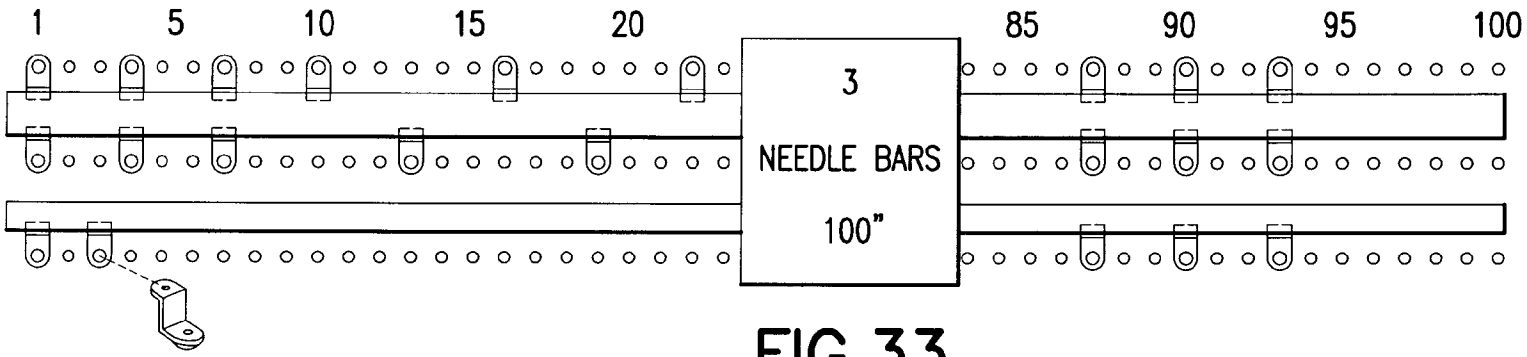
FIG. 33 shows an example configuration using three needle bars according to an embodiment of the present invention.
FIG. 34 shows an example configuration (in table format) using three needle bars according to an embodiment of the present invention.
Figure 35A:
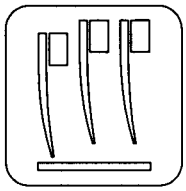
FIGS. 35A-35H show views of various example independent needle bar movement available using various embodiments of the present invention (each needle bar is shown end-on in these FIGS. 35A-35H, with each associated row of needles pointing downward).
Figure 35B:
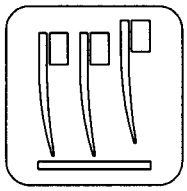
Figure 35C:
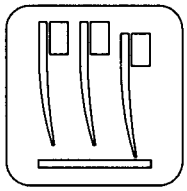
Figure 35D:
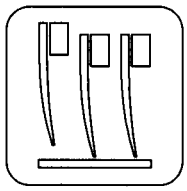
Figure 35E:
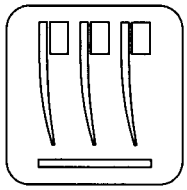
Figure 35F:
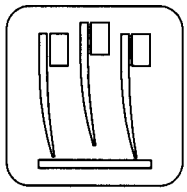
Figure 35G:
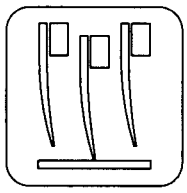
Figure 35H:
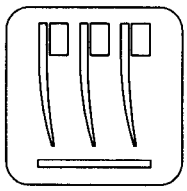

Referring now to FIG. 10, this Fig. shows a plan view of a portion of a machine with independent needle bars according to another embodiment of the present invention.

As described herein, various embodiments of the present invention may provide for the conversion of rotating motion (see, e.g., eccentric 17 and arrow N of FIG. 2A) to angular motion (see, e.g., arms 9,10,11 and arrows A,B,C of FIG. 1B).

In one example, all of the needle bars may be moved together (that is, at the same time in a manner such that movement of one needle bar is not independent from movement of the other needle bars). In another example, movement of one or more needle bars may be independent from movement of one or more other needle bars (this may be accomplished, for example, by engaging/disengaging one or more clamps as discussed herein). In another example, independently movable needle bars may be provided in a multiple needle bar machine (and/or method).

Of note, independently movable needle bars provided in a multiple needle bar machine (and/or method) may provide certain distinguishing feature(s) over an independent needle configuration. For example, an independent needle configuration may be very complicated (as compared, for example, to the above-mentioned independently movable needle bars configuration). In addition, an independent needle configuration may have problems with thread coming out of the needle when a given needle is raised above the work surface (this problem may be reduced or eliminated through use of the independently movable needle bars configuration described herein with reference to various embodiments of the present invention because a non-used needle bar may simply be left at rest). Further, in practice, independent needles may typically only be implementable on the first needle bar (due, for example, to the size of the implementing pistons and the limited space available in the vicinity of the needle bars (e.g., the limited space available between adjacent needle bars)).

In another embodiment, an independently movable needle bars configuration may be provided via a mechanism that permits one or more needle bars to be lifted up (such that the associated needles would not sew the work surface). In one example of this configuration, all of the needle bars may be moved together, but, as just mentioned, one or more of the needle bars may be raised as desired such that the needles associated with the raised needle bar(s) would not sew the work surface. Of course, the raised needle bar(s) could also be lowered when it was desired that the needles associated with such needle bar(s) would sew the work surface. In one specific example, needle bar(s) of this configuration could be raised/lowered using a rack and pinion gear system. In another example, each needle bar may be electrically, hydraulically and/or pneumatically raised/lowered. In another example, each needle bar may be raised/lowered under computer control. In another example, each needle bar may be raised/lowered together. In another example, each needle bar may be raised/lowered independently (that is, one or more of the needle bars may be raised at one time (such that the needles associated with the raised needle bar(s) would not sew the work surface) while one or more other needle bars may be left in the lowered position (such that the needles associated with the lower needle bar(s) would sew the work surface).

In another example, the machine may be a computer-implemented machine (e.g., implemented using one or more programmed processors).

In another example, the machine may operate at least in part in an automated manner.

In another example, the method may be a computer-implemented method (e.g., implemented using one or more programmed processors).

In another example, the method may be carried out at least in part in an automated manner.

In one example (which example is intended to be illustrative and not restrictive), a lock stitch may be carried out.

In another example (which example is intended to be illustrative and not restrictive), lock stitch cording may be carried out.

In another example (which example is intended to be illustrative and not restrictive), a moss stitch/chain chenille stitch may be carried out.

In another embodiment, a machine for making stitches with thread may be provided, comprising: at least one needle bar (see, e.g., needle bars 3, 4, 5 in FIGS. 1A and 1B), wherein the needle bar has attached thereto a plurality of needles (see, e.g., needles 1 in FIGS. 1A, 1B, 2A and 2B); a drive train (see, e.g., elements 17, 16, 15, 14, 13, 12, 8, 7 and 6 in FIG. 2B—of note, as described above, one or more motors (e.g., electric motors) may drive element 17); and at least one arm (see, e.g., arms 9, 10 and 11 in FIGS. 1A and 1B), the arm having a first end and a second end, the first end of the arm being connected to the drive train and the second end of the arm having attached thereto the needle bar; wherein the arm is moved by the drive train such that the second end of the arm moves along a path forming an arc; and wherein each of the plurality of needles is elongated along a long axis and wherein each of the plurality of needles is curved along the long axis.

In one example, the machine may perform one (or more) of: (a) sewing; (b) embroidering; and/or (c) quilting.

In another example, the machine may stitch a double chain stitch.

In another example, the machine may stitch a double-needle chain stitch.

In another example, the arc may be a semi-circular arc.

In another example, each of the arm(s) may be moved by the drive train such that the second end of each arm reciprocates back and forth along the path forming the arc.

In another example, at least a plurality of the needles may have the same radius of curvature along the long axis of each of the needles.

In another example, all of the needles may have the same radius of curvature along the long axis of each of the needles.

In another example, the radius of curvature of at least a first one of the plurality of the needles may be different along the long axis of the first one of the plurality of needles than the radius of curvature of at least a second one of the plurality of the needles along the long axis of the second one of the plurality of needles.

In another example, the machine may further comprise a programmed computer.

In another example, the drive train may comprise at least one motor.

In another example, the motor may comprise an electric motor.

In another embodiment, a machine for making stitches with thread is provided, comprising: a first needle bar (see, e.g., needle bars 3, 4, 5 in FIGS. 1A and 1B) having attached thereto a plurality of needles (see, e.g., needles 1 in FIGS. 1A, 1B, 2A and 2B); a second needle bar (see, e.g., needle bars 3, 4, 5 in FIGS. 1A and 1B) having attached thereto a plurality of needles (see, e.g., needles 1 in FIGS. 1A, 1B, 2A and 2B); a drive train (see, e.g., elements 17, 16, 15, 14, 13, 12, 8, 7 and 6 in FIG. 2B—of note, as described above, one or more motors (e.g., electric motors) may drive element 17); a first arm (see, e.g., arms 9, 10 and 11 in FIGS. 1A and 1B), the first arm having a first and a second end, the first end of the first arm being selectively driven by the drive train and the second end of the first arm having attached thereto the first needle bar; and a second arm (see, e.g., arms 9, 10 and 11 in FIGS. 1A and 1B), the second arm having a first and a second end, the first end of the second arm being selectively driven by the drive train and the second end of the second arm having attached thereto the second needle bar; wherein, when the first end of the first arm is driven by the drive train, the first arm is moved by the drive train such that the second end of the first arm moves along a path forming a first arc; wherein, when the first end of the second arm is driven by the drive train, the second arm is moved by the drive train such that the second end of the second arm moves along a path forming a second arc; and wherein the driving of the first end of the first arm by the drive train is independent of the driving of the first end of the second arm by the drive train.

In one example, the machine may perform one (or more) of: (a) sewing; (b) embroidering; and/or (c) quilting.

In another example, the machine may stitch a double chain stitch.

In another example, the machine may stitch a double-needle chain stitch.

In another example: the drive train may comprise a first connector element (see, e.g., connector elements 12, 13, 14 in FIGS. 2A and 2B), a second connector element (see, e.g., connector elements 12, 13, 14 in FIGS. 2A and 2B), a first rod (see, e.g., rods 6, 7, 8 in FIGS. 2A and 2B) and a second rod (see, e.g., rods 6, 7, 8 in FIGS. 2A and 2B); wherein the first end of the first arm may be fixed to the first rod and the first rod may be selectively rotated by engagement with the first connector element; and wherein the first end of the second arm may be fixed to the second rod and the second rod may be selectively rotated by engagement with the second connector element.

In another example: the first end of the first arm may be fixed to the first rod and the first rod may be selectively reciprocally rotated back and forth by engagement with the first connector element; and the first end of the second arm may be fixed to the second rod and the second rod may be selectively reciprocally rotated back and forth by engagement with the second connector element.

In another example, the first connector element may comprise a first clamp and the second connector element may comprise a second clamp.

In another example, each of the first clamp and the second clamp may comprise at least one of: (a) an electromagnet clamping element; (b) a hydraulic clamping element; and/or (c) a pneumatic clamping element.

In another example, the drive train may comprise at least one motor.

In another example, the motor may comprise an electric motor.

In another example, the drive train may comprise at least one motor operatively connected to reciprocally rotate the first connector element back and forth and to reciprocally rotate the second connector element back and forth.

In another example: the first arm may be moved by the drive train such that the second end of the first arm reciprocates back and forth along the path forming the first arc; and the second arm may be moved by the drive train such that the second end of the second arm reciprocates back and forth along the path forming the second arc.

In another example: when the first end of the first arm is not driven by the drive train the first arm may be essentially stationary; and when the first end of the second arm is not driven by the drive train the second arm may be essentially stationary.

In another example, the first arc and the second arc may have the same radius of curvature.

In another example, a radius of curvature of the first arc may be different from a radius of curvature of the second arc.

In another example: the first arc may be a semi-circular arc; and the second arc may be a semi-circular arc.

In another example, each of the plurality of needles may be elongated along a long axis and each of the plurality of needles may be curved along the long axis.

In another example, at least a plurality of the needles may have the same radius of curvature along the long axis of each of the needles.

In another example, all of the needles may have the same radius of curvature along the long axis of each of the needles.

In another example, a radius of curvature of at least a first one of the plurality of the needles may be different along the long axis of the first one of the plurality of needles than a radius of curvature of at least a second one of the plurality of the needles along the long axis of the second one of the plurality of needles.

In another example, the machine may further comprise a programmed computer.

In another example, the machine may further comprise a programmed computer, wherein the programmed computer may be operatively connected to the first clamp and the second clamp to provide independent control over the movement of the first arm and the second arm.

In another embodiment, a machine for making stitches with thread is provided, comprising: x number of needle bars (see, e.g., needle bars 3, 4, 5 in FIGS. 1A and 1B), each of the needle bars having attached thereto a plurality of needles (see, e.g., needles 1 in FIGS. 1A, 1B, 2A and 2B); a drive train (see, e.g., elements 17, 16, 15, 14, 13, 12, 8, 7 and 6 in FIG. 2B—of note, as described above, one or more motors (e.g., electric motors) may drive element 17); y number of arms (see, e.g., arms 9, 10 and 11 in FIGS. 1A and 1B), each of the arms having a first and a second end, the first end of each of the arms being selectively driven by the drive train and the second end of each of the arms having attached thereto one of the needle bars; wherein, when the first end of each of the arms is driven by the drive train, each of the arms is moved by the drive train such that the second end of each of the arms moves along a path forming an arc; wherein the driving of the first end of at least one of the arms by the drive train is independent of the driving of the first end of each of the other arms by the drive train; wherein x is an integer between 2 and 20; and wherein y is an integer between 2 and 20.

In one example, the driving of the first end of each of the arms by the drive train may be independent of the driving of the first end of each of the other arms by the drive train.

In another example, the present invention may be applied (e.g., as a machine and/or method) to a single needle machine or method.

As described herein, various embodiments of the present invention relate to a double chain stitch quilting machine.

In one example, the double chain stitch quilting machine may be capable of working up to 1,400 s.p.m.

In another example, movement is simplified and the number of mechanical parts needed are reduced.

In another example, a pretension system may be provided.

In another example, various 360 degree continuous pattern (s) may be stitched (e.g., at very high productivity) using various embodiments of the present invention.

In another example, production (e.g., stitching) of panel quilt pattern(s) that may be essentially impossible to produce in an essentially continuous manner by other means may be provided.

In another example, various pattern-link drawings may be stitched using various embodiments of the present invention.

In another example, various embodiments of the present invention may be used to operate on elastic knitted materials.

In another example, various embodiments of the present invention may provide for one or more of the following: independent presser feet (e.g., instead of a traditional presser plate); independent needle bars (e.g., with oscillating movements); dynamic and constant pretension of the materials; and/or real-time control of the yarn's tension (and/or of the thread's tension).

In another example, three independent needle bars may be utilized.

In another example, various embodiments of the present invention may be used to operate on one or more of the following: mattress; bed cover; and/or bed spread.

In another example, various standard quilting, 360 degree decorative patterns, and/or pattern-link movement may be produced using a single highly productive, flexible and efficient sewing system using various embodiments of the present invention.

In another example, a fully integrated computerized control system may be provided.

In another example, material of any desired thickness may be operated on (e.g., up to 2" foam plus 200 gr wadding).

In another example, various embodiments of the present invention may provide for any desired type of sewing, quilting, embroidery and/or the like.

In another example, high precision control of carriage and rolls may provide for one or more of the following: precision in 360 degree patterns; no skipped stitches in any direction; use of thin needles (e.g., 130/160); and or quilting of extra heavy or very thin filling materials.

In another example, a number of fixed looper positions (e.g., 100 fixed looper positions) may be provided (e.g., to accept any desired needle set and avoid a long down time to move and set the loopers at new positions).

In another example, independent positive presser feet (e.g., instead of a traditional presser plate) may provide for one or more of the following: presser feet only correspond to position of needles; very tight stitches; and/or more quilting thickness and puff effect.

In another example, a 90 degree looper bars reversing system may be provided (e.g., which may allow easy and fast looper threading operation).

In another example, bartack and jump (e.g., with an automatic top thread cutting system essentially assuring zero tail on top surface) may be provided.

In another example, an upper thread feeder with yo-yo action may be provided (e.g., such upper thread feeder with yo-yo action may, thanks to its progressive pulling action, allow a stronger closing of stitches without stressing the top threads (as compared, for example, to a traditional butterfly system)—thus avoiding thread breaks.

In another example, stop motion action may be provided for needles and/or loopers (this may allow, for example, visual control of the tension of every thread). In another example, the stop motion action may be integrated into software.

In another example, a working speed may be up to 1,400 spm.

In another example, a pattern range may be 360 degrees.

In another example, a carriage stroke may be 12" (305 mm).

In another example, there may be no theoretical limit in back sewing.

In another example, equalized stitch length in all directions may be provided.

In another example, there may be a three needle bar configuration as follows: 1"×3"×6".

In another example, a multi-roll material handing system may be provided.

In another example, stitch length may be ⅙ mm.

For the purposes of this disclosure, a computer readable medium is a medium that stores computer data in machine readable form. By way of example, and not limitation, a computer readable medium can comprise computer storage media as well as communication media, methods or signals. Computer storage media includes volatile and non-volatile, removable and non-removable media implemented in any method or technology for storage of information such as computer-readable instructions, data structures, program modules or other data. Computer storage media includes, but is not limited to, RAM, ROM, EPROM, EEPROM, flash memory or other solid state memory technology; CD-ROM, DVD, or other optical storage; cassettes, tape, disk, or other magnetic storage devices; or any other medium which can be used to tangibly store the desired information and which can be accessed by the computer.

Further, the present invention may, of course, be implemented using any appropriate computer readable medium, computer hardware and/or computer software.

As mentioned, the techniques described herein may, of course, be computer implemented and may utilize any appropriate computer hardware and/or computer software. In this regard, those of ordinary skill in the art are well versed in the type of computer hardware that may be used (e.g., a personal computer ("PC"), a network (e.g., an intranet and/or the Internet)), the type of computer programming techniques that may be used, and the type of computer programming languages that may be used. The aforementioned examples are, of course, illustrative and not restrictive.

Of course, any embodiment/example described herein (or any feature or features of any embodiment/example described herein) may be combined with any other embodiment/example described herein (or any feature or features of any such other embodiment/example described herein).

While a number of embodiments of the present invention have been described, it is understood that these embodiments are illustrative only, and not restrictive, and that many modifications may become apparent to those of ordinary skill in the art. For example, any desired number and/or type of motors(s) may be utilized (e.g., electric AC motor(s); electric DC motors(s); electric stepper motor(s); electric induction motor (s); electric linear motor(s); electric actuators (e.g., linear actuator(s)); piston(s) (hydraulic and/or pneumatic)). Further still, any desired number of needle(s) may be used on any desired number of needle bar(s). Further still, any desired number of arm(s) may be used on any given needle bar (e.g., multiple arms for each needle bar). Further still, any desired number of arm(s) may be used on any given rotating rod (e.g., multiple arms for each rotating rod). Further still, any desired number of rotating rod(s) may be utilized. Further still, any desired number of hooks(s) may be utilized. Further still, any desired number of presser feet may be utilized. Further still, any reciprocation described herein may be, for example, a back-and-forth oscillation. Further still, any rotation described herein may be, for example, a back-and-forth rotation or a rotation in one direction only. Further still, the various steps may be carried out in any desired order (and any desired steps may be added and/or any desired steps may be eliminated).

What is claimed is:

1. A machine for making stitches with thread, comprising: at least one needle bar, wherein the needle bar has attached thereto a plurality of needles; a drive train; and at least one arm, the arm having a first end and a second end, the first end of the arm being connected to the drive train and the second end of the arm having attached thereto the needle bar; wherein the arm is moved by the drive train such that the second end of the arm moves along a path forming an arc; and wherein each of the plurality of needles is elongated along a long axis and wherein each of the plurality of needles is curved along the long axis.

2. The stitching machine of claim 1, wherein the machine performs one of: (a) sewing; (b) embroidering; and (c) quilting.

3. The stitching machine of claim 1, wherein the machine stitches a double chain stitch.

4. The stitching machine of claim 1, wherein the arc is a semi-circular arc.

5. The stitching machine of claim 1, wherein the arm is moved by the drive train such that the second end of the arm reciprocates back and forth along the path forming the arc.

6. The stitching machine of claim 1, wherein at least a plurality of the needles have the same radius of curvature along the long axis of each of the needles.

7. The stitching machine of claim 6, wherein all of the needles have the same radius of curvature along the long axis of each of the needles.

8. The stitching machine of claim 1, wherein the radius of curvature of at least a first one of the plurality of the needles is different along the long axis of the first one of the plurality of needles than the radius of curvature of at least a second one of the plurality of the needles along the long axis of the second one of the plurality of needles.

9. The stitching machine of claim 1, further comprising a programmed computer.

10. The stitching machine of claim 1, wherein the drive train comprises at least one motor.

11. The stitching machine of claim 10, wherein the motor comprises an electric motor.

12. A machine for making stitches with thread, comprising: a first needle bar having attached thereto a plurality of needles; a second needle bar having attached thereto a plurality of needles; a drive train; a first arm, the first arm having a first and a second end, the first end of the first arm being selectively driven by the drive train and the second end of the first arm having attached thereto the first needle bar; and a second arm, the second arm having a first and a second end, the first end of the second arm being selectively driven by the drive train and the second end of the second arm having attached thereto the second needle bar; wherein, when the first end of the first arm is driven by the drive train, the first arm is moved by the drive train such that the second end of the first arm moves along a path forming a first arc; wherein, when the first end of the second arm is driven by the drive train, the second arm is moved by the drive train such that the second end of the second arm moves along a path forming a second arc; and wherein the driving of the first end of the first arm by the drive train is independent of the driving of the first end of the second arm by the drive train.

13. The stitching machine of claim 12, wherein the machine performs one of: (a) sewing; (b) embroidering; and (c) quilting.

14. The stitching machine of claim 12, wherein the machine stitches a double chain stitch.

15. The stitching machine of claim 12, wherein: the drive train comprises a first connector element, a second connector element, a first rod and a second rod; wherein the first end of the first arm is fixed to the first rod and the first rod is selectively rotated by engagement with the first connector element; and wherein the first end of the second arm is fixed to the second rod and the second rod is selectively rotated by engagement with the second connector element.

16. The stitching machine of claim 15, wherein: the first end of the first arm is fixed to the first rod and the first rod is selectively reciprocally rotated back and forth by engagement with the first connector element; and the first end of the second arm is fixed to the second rod and the second rod is selectively reciprocally rotated back and forth by engagement with the second connector element.

17. The stitching machine of claim 16, wherein the first connector element comprises a first clamp and the second connector element comprises a second clamp.

18. The stitching machine of claim 17, wherein each of the first clamp and the second clamp comprises at least one of: (a) an electromagnet clamping element; (b) a hydraulic clamping element; and (c) a pneumatic clamping element.

19. The stitching machine of claim 18, wherein the drive train comprises at least one motor.

20. The stitching machine of claim 19, wherein the motor comprises an electric motor.

21. The stitching machine of claim 18, wherein the drive train comprises at least one motor operatively connected to reciprocally rotate the first connector element back and forth and to reciprocally rotate the second connector element back and forth.

22. The stitching machine of claim 12, wherein: the first arm is moved by the drive train such that the second end of the first arm reciprocates back and forth along the path forming the first arc; and the second arm is moved by the drive train such that the second end of the second arm reciprocates back and forth along the path forming the second arc.

23. The stitching machine of claim 12, wherein: when the first end of the first arm is not driven by the drive train the first arm is essentially stationary; and when the first end of the second arm is not driven by the drive train the second arm is essentially stationary.

24. The stitching machine of claim 12, wherein the first arc and the second arc have the same radius of curvature.

25. The stitching machine of claim 12, wherein a radius of curvature of the first arc is different from a radius of curvature of the second arc.

26. The stitching machine of claim 12, wherein: the first arc is a semi-circular arc; and the second arc is a semi-circular arc.

27. The stitching machine of claim 12, wherein each of the plurality of needles is elongated along a long axis and wherein each of the plurality of needles is curved along the long axis.

28. The stitching machine of claim 12, wherein at least a plurality of the needles have the same radius of curvature along the long axis of each of the needles.

29. The stitching machine of claim 12, wherein all of the needles have the same radius of curvature along the long axis of each of the needles.

30. The stitching machine of claim 12, wherein a radius of curvature of at least a first one of the plurality of the needles is different along the long axis of the first one of the plurality of needles than a radius of curvature of at least a second one of the plurality of the needles along the long axis of the second one of the plurality of needles.

31. The stitching machine of claim 12, further comprising a programmed computer.

32. The stitching machine of claim 17, further comprising a programmed computer, wherein the programmed computer is operatively connected to the first clamp and the second clamp to provide independent control over the movement of the first arm and the second arm.

33. A machine for making stitches with thread, comprising: x number of needle bars, each of the needle bars having attached thereto a plurality of needles; a drive train; y number of arms, each of the arms having a first and a second end, the first end of each of the arms being selectively driven by the drive train and the second end of each of the arms having attached thereto one of the needle bars; wherein, when the first end of each of the arms is driven by the drive train, each of the arms is moved by the drive train such that the second end of each of the arms moves along a path forming an arc; wherein the driving of the first end of at least one of the arms by the drive train is independent of the driving of the first end of each of the other arms by the drive train; wherein x is an integer between 2 and 20; and wherein y is an integer between 2 and 20.

34. The stitching machine of claim 33, wherein the driving of the first end of each of the arms by the drive train is independent of the driving of the first end of each of the other arms by the drive train.

* * * * *